US011040794B2

(12) United States Patent
Potter et al.

(10) Patent No.: US 11,040,794 B2
(45) Date of Patent: Jun. 22, 2021

(54) DIRECT GAS-FIRED PROCESS AIR HEATER ASSEMBLY UTILIZING A PREMIX BURNER APPLIED TO A SHRINK WRAP CONVEYER OVEN

(71) Applicants: Gary J Potter, Marthasville, MO (US); Gary J Potter, Jr., Mooresville, IN (US)

(72) Inventors: Gary J Potter, Marthasville, MO (US); Gary J Potter, Jr., Mooresville, IN (US)

(73) Assignee: Advanced Design Engineering, LLC, Marthasville, MO (US)

( * ) Notice: Subject to any disclaimer, the term of this patent is extended or adjusted under 35 U.S.C. 154(b) by 253 days.

(21) Appl. No.: 16/501,437

(22) Filed: Apr. 16, 2019

(65) Prior Publication Data

US 2019/0322401 A1 Oct. 24, 2019

Related U.S. Application Data

(60) Provisional application No. 62/762,108, filed on Apr. 19, 2018.

(51) Int. Cl.

| | |
|---|---|
| ***B65B 53/06*** | (2006.01) |
| ***F23D 14/14*** | (2006.01) |
| ***F23C 99/00*** | (2006.01) |
| *F23M 5/02* | (2006.01) |

(52) U.S. Cl.

CPC ..... *B65B 53/063* (2013.01); *F23C 99/006* (2013.01); *F23D 14/14* (2013.01); *F23M 5/02* (2013.01)

(58) Field of Classification Search

CPC ..... F23D 14/14; F23D 14/70; F23C 99/006; F23C 3/002; F23M 5/02; B65B 53/063

See application file for complete search history.

(56) References Cited

U.S. PATENT DOCUMENTS

| | | | | | |
|---|---|---|---|---|---|
| 3,993,449 | A * | 11/1976 | Childs | F23G 5/14 | 422/172 |
| 4,597,247 | A * | 7/1986 | Johnson | B65B 53/063 | 53/557 |
| 4,749,943 | A * | 6/1988 | Black | G01R 1/073 | 29/739 |
| 4,929,541 | A * | 5/1990 | Potter | F23D 14/34 | 432/222 |
| 4,938,203 | A * | 7/1990 | Thrasher | F24H 3/065 | 126/11 OR |
| 4,993,944 | A * | 2/1991 | Potter | F24H 3/0488 | 432/222 |

(Continued)

*Primary Examiner* — David J Laux
*Assistant Examiner* — Nikhil P Mashruwala
(74) *Attorney, Agent, or Firm* — Paul M. Denk

(57) ABSTRACT

A direct gas-fired process air heater assembly that utilizes a premix burner applied to a shrink wrap conveyor oven for uniform dissemination of heated air into the a recirculating air stream of a circulating blower, said air circulating blower directing the heated air into the shrink wrap chamber or tunnel for shrinking polymer film around packaged goods for shipment and/or storage. According to various aspects, exemplary embodiments are disclosed of the direct gas-fired packaged process air heater assembly construction features including the application of premix burner technology.

21 Claims, 13 Drawing Sheets

(56) References Cited

U.S. PATENT DOCUMENTS

| | | | | | |
|---|---|---|---|---|---|
| 5,083,918 | A * | 1/1992 | Potter | F24H 3/0488 | 432/222 |
| 5,899,048 | A * | 5/1999 | Havens | B65B 53/063 | 53/442 |
| 6,526,964 | B1 * | 3/2003 | Potter | F24H 3/0488 | 126/110 C |
| 9,163,856 | B2 | 10/2015 | Potter | | |
| 2018/0209740 | A1 * | 7/2018 | Beesley | B65B 53/063 | |

* cited by examiner

DIRECT GAS-FIRED PROCESS AIR HEATER ASSEMBLY UTILIZING A PREMIX BURNER APPLIED TO A SHRINK WRAP CONVEYER OVEN

CROSS REFERENCE TO RELATED APPLICATION

This non-provisional patent application claims priority to the provisional patent application having Ser. No. 62/762,108, filed on Apr. 19, 2018.

FIELD OF THE INVENTION

This invention relates to the use of a gas-fired premix combustion air/gas burner system for generating sufficient heat in conjunction with a unique heat distribution assembly that uniformly disseminates that heat into a re-circulating air stream across the width of a conveyor oven and into the suction side of the circulating air blower for supplying that heated air into the conveyor chamber to uniformly shrink the polymer film around packaged goods, as a means to secure the product during shipment, distribution and sale.

BACKGROUND

Heat-shrink conveyor systems are utilized in the packaging industry to replace cardboard cartons with, in many cases, a cardboard tray and a thin film of plastic material which when heated forms around the containers to physically hold product in place. Some products utilize only the plastic film. Examples of such products include water bottles, soda and beer cans, other can or bottle products, such as soups, sauces or vegetables and box products, such as cake mix, broths or brown sugar. Even small bags of potato chips, Fritos and Doritos are being packaged in this manner.

The majority of conveyor system includes an enclosure above a moving conveyor which forms a tunnel to contain the heated air around the product passing through the chamber. The heated air passes from the chamber back across the electric heater elements and then into the circulating fan where it discharges back into the chamber in a re-circulating manner. Drawing air across an electrical heating bank that spans the width of the tunnel attempts to create an even temperature distribution within the chamber where the plastic material shrinkage is to take place. It is very important that the temperature in the chamber be uniform so that the plastic material shrinks evenly against the packaged product.

The operating temperature needed to accomplish the proper shrink effect in a tunnel requires that temperatures to be in excess of 350° F., however, the speed of the product moving through the tunnel may require the chamber temperature to reach temperatures approaching 450° F. as the time at temperature has an equivalency factor activating the "shrink" feature. The specified temperature must also be held at the set-point within very close tolerances generally within plus or minus 2%. This becomes important should the volume of product flowing through the tunnel changes abruptly. Thus the need for a fast responding modulation controls system of the heating system.

Prior to 2010, electric heating systems had been utilized exclusively to provide the elevated air temperature required to activate the "shrink" feature of the thin-film plastic material. The allowable space for any alternative heating section has been limited to that provide for the electric heater section because of the need to retrofit existing electric heating systems with a gas system in the future.

Over the last few years, gas heater systems with power burners have begun making in-roads into this marketplace to address the high operating cost of the electric heater systems. The higher sales cost of the gas systems has limited the market share to approximately 20% of the total volume.

The shrink wrap conveyor manufacturers found that the gas heater systems reached the desired operating temperature significantly faster than the electric version which translates into timed saved for each start cycle.

Additionally, the shrink wrap conveyor manufacturers found that the moisture generated from the gas combustion process activated the "shrink" feature at a 30 to 40° F. lower operating temperature than the electric version which translates energy savings for each hour that it operates due to the improved efficiency.

Just the operating cost difference in most regions of the United Stated between electrical power and natural gas operating at a thermal efficiency of 100% more than justifies a slight premium of the gas system solution cost over the electric heater.

The design of the gas burners that have been applied to the shrink wrap conveyor equipment, up to now, have been power burner designs with a blower that delivers air to a burner head where the gas and air are mixed in the combustion chamber and ignited. Burner systems that are utilized in process applications, like the shrink oven conveyor, can be certified by third party laboratories to ANSI Standard Z83.25 for Direct Gas-Fired Packaged Process Air Heaters and Duct Heaters. This Standard has established combustion limits for the heaters that provide ventilation air during times when personnel are present at 5 ppm for carbon monoxide, 0.5 ppm for nitrogen dioxide and 4,000 ppm for carbon dioxide. There are no combustion limits in this Standard when the heater is used in the process mode where personnel are prohibited from occupying. In conveyor ovens, these burners operate continuously in the process mode.

Non-certified heaters can also be designed to meet the requirements of NFPA 86: Standard for Ovens and Furnaces, but this Standard does not include requirements that places limits on combustion emissions.

From previous experience designing and testing these types of power burners that comply with the combustion limits of 5 ppm CO, 0.5 ppm NO2 and 4.000 ppm CO2, this style of burner produce between 55 and 70 ppm of nitrogen oxides (NOx) which is recognized as a green house gas that is known to have a role in global warning.

The South Coast Air Quality Management District (SCAQMD) has long been recognized as the leader in establishing the greenhouse gas emissions limits for gas utilization equipment by providing Rules for each type of appliance. Their Rules apply to the localized areas around Los Angeles encompassing five adjoining counties. The SCAQMD activities over the years were responsible for alleviating the smog that had impacted the air quality in the LA basin.

On Jan. 1, 2010, SCAQMD Rule 1147 became effective and addressed nearly all other gas utilization equipment not previously covered by other published SCAQMD Rules. This expansion of coverage includes direct gas-fired process air heaters and limits NOx generation to 30 ppm air free.

As a result of the implementation of SCAQMD Rule 1147, direct gas-fired process heaters must demonstrate compliance with the 30 ppm NOx requirement if they are to be installed in the area covered by the SCAQMD boundaries. It has generally been found that burners designed that utilize premix fuel/air technology have been successful in demonstrating compliance to the 30 ppm NOx requirement.

The shrink wrap conveyor manufacturer has indicated that a number of customers with electric heater systems in the boundary areas covered by SCAQMD Rules have expressed interest in retrofitting their tunnels to gas but because of their plant location, the burner systems must demonstrate compliance to the SCAQMD Rule 1147.

SUMMARY OF THE INVENTION

This invention utilizes a zero governor regulated gas valve in conjunction with a premix combustion fuel/air blower with integral inlet venturi delivering the gas/air mixture to a premix burner in order to yield combustion emissions that are well below that required to demonstrate compliance with the SCAQMD Rule 1147. The principle of premix is to provide sufficient air to consume all the fuel for complete combustion. The zero governor regulated gas valve responds to the negative pressure that occurs as air flows into the venturi based on the selected speed of the combustion fuel/air blower. The specific relationship between the airflow and the gas flow to achieve stoichiometric fuel to air ratio is accomplished by adjusting needle-valve screw that is provided on the gas valve.

These previously identified controls and control characteristics have been successfully applied on boilers and pool heaters in the past to deliver low NOx performance. Both these systems are indirect gas-fired heating systems where the exhaust gases are vented out to atmosphere. The heat transfer for these systems is solely accomplished by indirect conduction from a firing tube heat exchanger to the surrounding flow of liquid which in most cases is water.

The combustion fuel/air mixture is delivered to the burner head where it passes through a special perforated sheet metal cylinder that imparts a swirl pattern of the burner flame within the firing tube. The small diameter holes in the perforated cylinder prevent the fuel air mixture from igniting the fuel/air mixture upstream of the perforated cylinder.

As previously mentioned, the shrink wrap conveyor ovens require the temperature to be evenly distributed across the width of the heating device so as to uniformly disseminates that heat into a re-circulating air stream and into the suction side of the circulating air blower for supplying that heated air into the conveyor chamber to uniformly shrink the polymer film around packaged goods, as a means to secure the product during shipment, distribution and sale.

As with previous gas burners systems employed in shrink wrap conveyor ovens, a point heat source that fires through the side wall of the oven, the configuration of the heat distribution system is the key for meeting the heat distribution criteria established by the conveyor oven manufacturer. In the prior art of a direct gas-fired power burner, the burner fires into a heat box that utilizes a linear slot to disseminate the heated air into the air stream of the conveyor oven. In the case of the current invention, a burner firing tube is provided on the outlet of the burner to act as a barrier to prevent flame impingement by the circulating airflow. In the preferred embodiment of the burner firing tube consist of the top and bottom formed sheet metal panels which when combined forms an octagon, thus simulating a non-curvature design of a tube. The burner firing tube allows the combustible gas mixture to be fully consumed by the flame prior to reaching the end of the burner firing tube on opposite side of the conveyor oven. The high temperature of the heat of combustion air that exits the burner firing tube is discharged into a uniquely formed refractory block design. The refractory block is configured to turn all of the high temperature heat of combustion air back toward the opposite end of the conveyor.

In the process of turning the high temperature heat of combustion air that typically ranges from 1375° F. to 2100° F., the refractory block absorbs a portion of the heat during burner operation. The high temperature of the refractory block acts like an afterburner in a burn-off oven which reduces the carbon emissions contained in the combustion air that passes through the refractory block resulting in 0 or near 0 CO emissions air free. The refractory block enclosure is furnished with ventilation holes above and below the refractory block to capture some of the conducted heat from the refractory block and deliver it to the circulating air stream.

The ventilated tube consists of a top and bottom formed sheet metal panel, which when combined, form an octagon, creating a larger non curvature design of a tube. The ventilated tube seals against the outside perimeter of the cutout in the refractory block forcing the high temperature heat of combustion air inside of the various open cavities that exist between the firing tube and the sides of the ventilated tube.

There are air block-offs attach to the interior surface of the top and bottom ends of the ventilated tube and extend to the exterior end of the burner firing tube to block the high temperature heat of combustion air from entering the blocked top and bottom section of the ventilated tube in order to force the remaining portion of the high temperature heat of combustion air into the top and bottom openings between the temperature balancing channels and the ventilated tube.

The portion of the high temperature heat of the combustion air that enters the open side cavities between the ventilated tube and the firing tube, as indicated above, starts to become diluted as it moves along the length of those side cavities by the circulating air flow of the conveyor oven blower due to the ventilation holes along each side of the ventilated tube. The remaining portion of the high temperature heat of the combustion air enters the cavities of the top and bottom temperature balancing channels. There are a limited number of ventilation holes spaced evenly along the length of the temperature balancing channel so that the high temperature heat of the combustion air within the temperature balancing channels is diluted and cooled as it moves to the burner end. Ventilation holes have been provided on the opposite side of the temperature balancing channel and to the ventilated tube directly under the temperature balancing channel to deliver a portion of the diluted high temperature heat of the combustion air to the center section of the heater assembly to evenly distribute the heated air along the length of the heater assembly.

As the circulating air flow of the conveyor oven blower passes through the portion of the ventilated tube that surrounds the burner firing tube, not only does it dilute the high temperature heat of the combustion air, it also absorbs some of the conducted heat from the surface of the burner firing tube as the circulating air passes through the ventilated tube. The circulating airflow cools the metal surfaces of the burner firing tube, the ventilated tube, the refractory block enclosure and the temperature balancing channel to remain below the thermal rating of these sheet metal components.

The burner firing tube surface tends to be hotter from direct flame impingement inside the firing tube closer to the burner outlet, near the insulated bulkhead, so there would be more heat transfer to the conveyor oven circulating air flow from conduction closer to the burner than is produced on the far end of the burner firing tube. On the far end of the burner firing tube, the high temperature heat of the combustion air that is returned to the outside of the firing tube and inside the ventilating tube by the refractory block contributes more heat than is available from the conducted firing tube heat. The heat of combustion air also enters the temperature balancing channel from the refractory block and is distributed along the length of the temperature balancing channel with a portion of the heated combustion air delivered to the center section of the ventilated tube length to better spread the thermal rise more evenly along the length of the heater assembly.

From the above description, the even temperature distribution is also the result of the combination of the heat from conduction for a portion of the firing tube, the external surface of the temperature balancing channel, the ventilation tube under the temperature balancing channel, the refractory block and refractory block enclosure assembly. The even temperature distribution is the result of the combination of the heat from the high temperature heat of the combustion air from the far end of the ventilated tube/fire tube cavity, the center of the ventilation tube through the holes under the temperature balancing channel and the temperature balancing channel holes along the length on the heater assembly. All of the following component contribute to the even temperature of the heater assembly by the unique design elements of the firing tube, refractory block, refractory block enclosure, tube block-offs, ventilated tube, temperature balancing channels and air restrictor baffles.

Airflow restrictor baffles are provided along the length of the heater assembly above and below the temperature balancing channel in order to create a pressure drop to push the oven's circulating airflow into the ventilation holes provided. As the physical size of these baffles increase, a larger portion of the circulating airflow is force to penetrate the ventilation holes provided in the ventilated tube and temperature balancing channel. The more air that flows through the ventilation holes on the upstream side of the heater assembly, the lower the temperature rise leaving the ventilation holes on the downstream side of the heater assembly.

The circulating air that passes between the air restrictor baffle and the mounting rail does not absorb any heat and is therefore considered bypass air which serves blend the temperature gain across the heater assembly prior to the mixing action of the circulating air blower. A secondary impact of increasing the height of the air restrictor baffles, relates to the reduction of the bypass air volume as well as the overall air throughput of the circulating air flow unless the speed of the circulating air blower is increased accordingly.

It is anticipated the height of the air restrictor baffle will be sized differently for different conveyor oven manufacturers based optimization of circulating blower's performance characteristics and temperature variations across the width of the conveyor oven. It is also anticipated on some conveyor applications that one might experience slightly higher temperatures near the burner end and at the opposite end of the heater assembly while experiencing slightly lower temperatures in the center section. In this case, increasing the height of the restrictor baffle for only the center section would increase the air volume on the end sections including bypass air to improve the thermal mixing across the heater assembly.

As will be shown in the description of the drawing, a round firing tube and round ventilated tube are alternative designs covered by this patent application. During the evaluation of alternative designs, it was found that the availability of round high temperature thin wall stainless steel tubing in the 4 and 6 inch size was not found in the metropolitan St. Louis area and when it was located elsewhere in the United States, pricing was found to be in excess of $75.00 per foot of length. Additionally, the fabrication of the 6 inch OD ventilated tube requires a multiple axis laser to cut the holes and slots that are present in the embodiment of the design. The search for a potential supplier found only one fabricator in the St. Louis area that had a laser cutter that could handle 6 inch OD tubing and this supplier opted out of consideration because, although the machine was rated for 6 inch tubing, they had never attempted tubing that large and question whether it could actually accomplish the job. This supplier also indicated that a tube with as many holes as this design would be quite expensive to process and would likely exceed $125.00 per assembly.

The formed sheet metal design of both the burner firing tube and the ventilated tube in the octagon configuration was necessitated because of cost constraints of the heater assembly. The goal of this design effort was to achieve a gas premix heater design that would have a sales price point more closely aligned to the current electric heater system level.

The formed sheet metal design offers an additional unique feature that was not readily available on the round tube design. The flanged joint along the length of the burner firing tube extends to nearly close off the gap between the burner firing tube and the ventilated tube. The flanged joint of the burner firing tube effectively minimizes any circulating air patterns between the tube-haves. The air on the upstream side that independently enters the ventilation holes of the top section of the ventilated tube leaves through the ventilation holes on the top section of the ventilated tube on the downstream side. Similarity, the air on the upstream side that independently enters the ventilation holes of the bottom section of the ventilated tube leaves through the ventilation holes on the bottom section of the ventilated tube on the downstream side.

The heater assembly is also uniquely designed so as to serve unchanged between a left hand and right hand application by being bi-directional with respect to the circulating air flow. Dual mounting rails are provided on both top and bottom to help facilitate this design feature. All of the features describe above combine to uniformly disseminates the heat added by the burner into a re-circulating air stream across the width of a conveyor oven and into the suction side of the circulating air blower for supplying the heated air into the conveyor chamber to uniformly shrink the polymer film around packaged goods, as a means to secure the product during shipment, distribution and sale.

The unique design characteristic of the heater assembly that is the subject of this patent application for conveyor type shrink ovens lends itself to other direct gas-fired process air heating applications including drying ovens and curing ovens that utilize a centralized blower to recirculate the heated air in enclosed area that encompasses the process activity.

The heater assembly in these applications is commonly mounted in ductwork that typically draws air from the bottom perimeter of the enclosure and passes it across the heat exchanger to the inlet of a circulating blower that discharges the heated air back to the processing chamber to continuously mix the heated circulating air to maintain even temperature throughout the chamber.

The uniform temperature rise across the heater assembly, as described above, for the shrink wrap conveyor oven application significantly enhances the even temperature distribution with-in the heated chambers of curing oven and drying oven applications. A fresh air intake normally mounted on the ductwork on the suction side of the circulating blower provides dilution air to the circulating air stream that matches the exhaust fan airflow capacity in order to remove a small portion of the air from the chamber to maintain proper air quality as it relates to emissions from the drying or curing process as well as combustion emissions from the burner. The combination of the fresh air intake and the exhaust fan provides the system ventilation that occurs in the shrink wrap conveyor ovens by the high speed flow of products into and out of the conveyor oven.

When a paint booth operates in the paint drying mode, the paint booth system functions very similar to a drying oven or curing oven, although, there are other times while painting is occurring and tempered ventilation air is supplied to provide a comfortable and safe working environment for the painter. In these applications it is common to utilize an end item heater assembly that is certified to ANSI Standard Z83.25 for Direct Gas-Fired Packaged Process Air Heaters and Duct Heaters to provide the fresh air ventilation during the painting operation that is interlocked with an exhaust system to expel that air to prevent over pressurizing the paint booth chamber. In the paint drying mode, the outside air opening to the process air heater is restricted by partially closing the fresh air damper and opening the recirculating damper in order to reduce the energy requirement that would be associated with the higher drying temperature.

The utilization of a certified Direct Gas-Fired Packaged Process Air Heater Assembly or Direct Gas-Fired Process Duct Heater Assembly that incorporated a Premix Burner as an end item for paint booth applications expands the arena where the unique features of this patent can be applied. The emissions from the premix burner not only comply with the NOx requirements of the SCAQMD, but they easily meet the ventilation air quality limits stated earlier for ANSI Standard Z83.25.

The emission limits for ventilation air of ANSI Standard Z83.25 are identical to the combustion limits of ANSI Standard Z83.4 for Non-recirculating Direct Gas-Fired Packaged Forced Ventilation and Duct Heating Appliance for Commercial and Industrial Applications. As such, the heater assembly of this invention can also apply to both draw through and blow through configurations of heaters certified to ANSI Standard Z83.4. These heaters are utilized to provide make-up air and space heat to industrial and commercial facilities. The unique design features of the heater assembly addressed in this patent are congruent with design elements of these end item heater assemblies with distinct advantages over the prior art for these heaters. One of the major advantages of the current invention is that there is no visible flame during burner operation. Since the temperature leaving the heat exchanger is slightly elevated above the desired discharge temperature, the clearance distance on draw through heater configurations where the blower is downstream of the heater assembly are significantly reduce compared to flame impingement concerns that are applicable to the existing line burner technology of existing draw-through heaters which require between 36 and 42 inches of clearance on downstream components, such as blowers, motors and controls. Additionally, visible flame from the existing burner technologies on blow-through heater configurations where the burner is located downstream of the blower can generate concerns from the building occupants. The leading manufacturer of heaters of this heater configuration provides discharge elbows and/or downturns on the heater outlet to block the direct sight of the burner flame.

Figure 1:
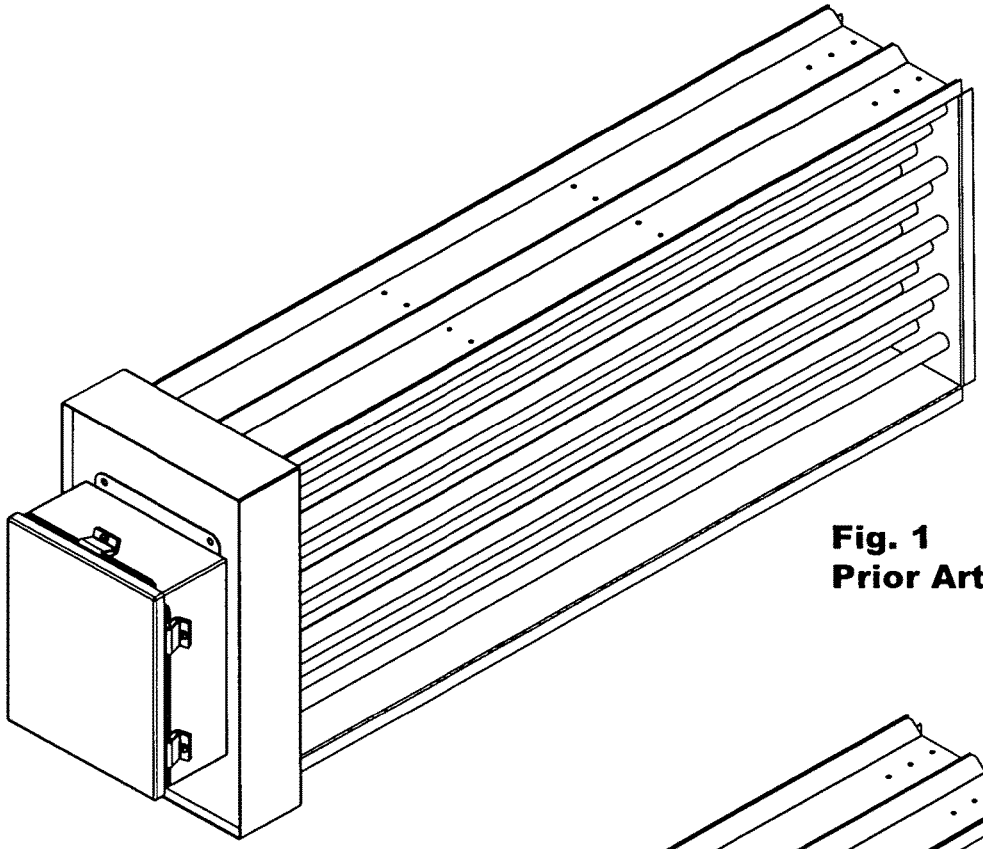
Fig. 1 Prior Art
FIG. 1 provides an isometric view of a generic electric heater bank with an electrical junction box to illustrate the prior art.

The attached Appendix discloses a listing of the identification of the heater assembly parts, and their reference characters or item part numbers.

DETAILED DESCRIPTION OF PREFERRED EMBODIMENTS

In referring to the drawings, FIG. 1, the current version and prior art of an electric heater assembly is shown that includes the insulated bulkhead with an external electrical junction box. This design has electric heating elements that traverse the full width and height of the assembly that is inside the conveyor oven chamber. It is easily understood that the heat generated by electric elements is uniformly released to the circulating air stream being drawn through the heater element and into the blower inlet.

Figure 2:
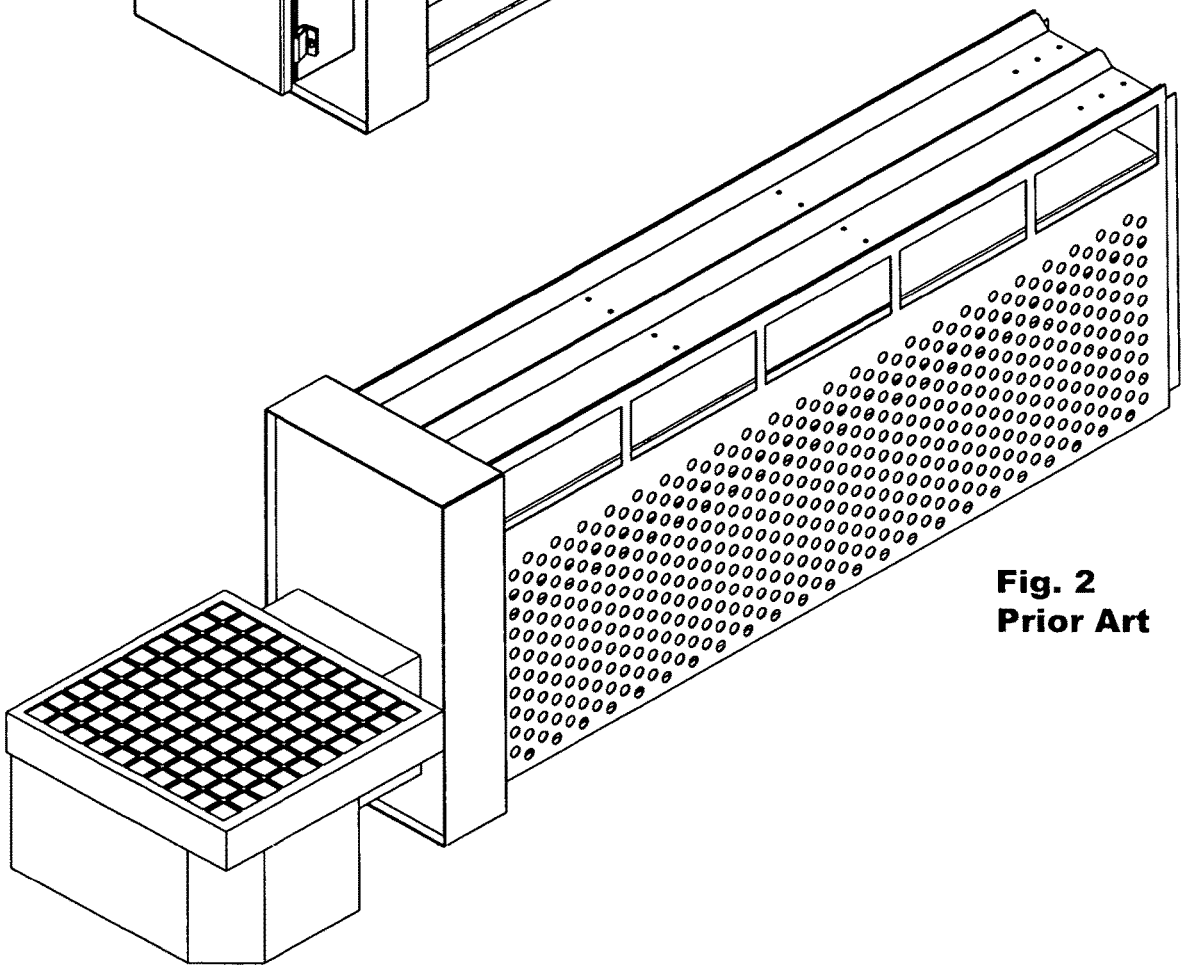
Fig. 2 Prior Art
FIG. 2 shows an isometric view of the prior art of a direct gas-fired power burner assembly with its attached heat box with an integral linear slot that is located within a hot air envelop.

FIG. 2 shows the current version and prior art of a gas-fired heater assembly which includes a power burner design that is mounted in the insulated bulkhead that contains an embedded combustion air blower that supplies the air to the burner section necessary for attaining complete combustion. The burner outlet is connected to a rectangular shaped fire box that includes a formed linear slot (not shown) through the top surface where the heated air is discharged into the circulating air stream as it passes through the cavity formed above the fire box and below the top of the hot air envelope.

Figure 3:
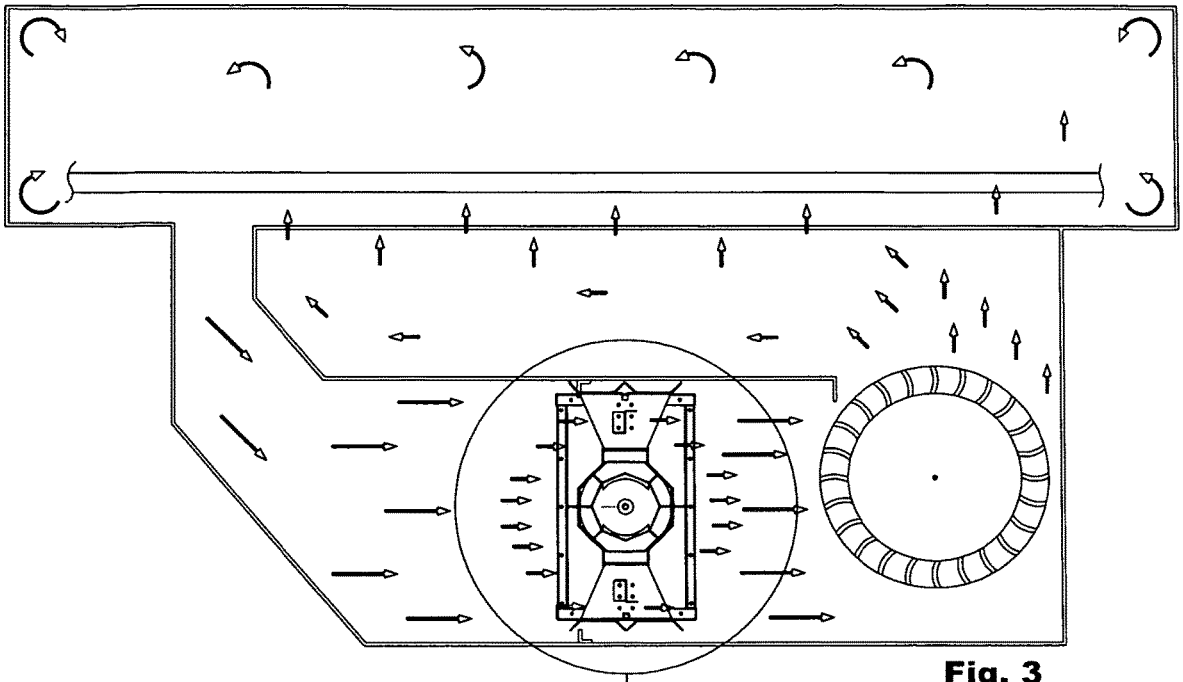
FIGS. 3 and 3*a* depict section views of a generic shrink wrap conveyor oven with the heater assembly of the current invention installed in its' intended location with an enlarged depiction of the air circulating flow through the heater assembly.

FIG. 3 depicts a section view of a generic shrink wrap conveyor oven that shows a section view of the premix gas-fired heater assembly 1 of the current invention in the same location provided for either of the prior art electric or gas-fired heater assembly design as shown in FIG. 1 and FIG. 2, respectively. The circulating airflow is shown as it passes through the heater assembly and is circulated through the rest of the shrink oven conveyor system.

Figure 3A:
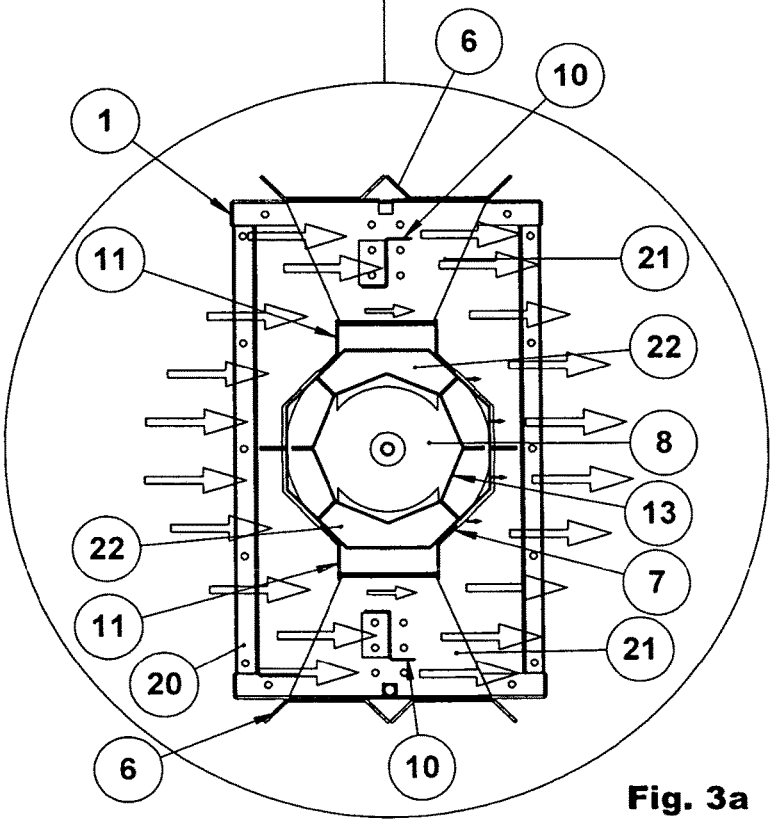

FIG. 3*a* demonstrates the air that enters the octagon shaped ventilated tube 7 is routed around the octagon shaped burner firing tube 1 to discharge out the opposite side of the ventilated tube 7. The cavity formed between the ventilated tube 7 and the burner firing tube 13 is where the majority of the heat from the heat of combustion interacts and mixes with the circulating air steam by way of one of the following heat transfer methods: a. the circulating airflow absorbs the conducted heat of the burner firing tube 13 from the heat from combustion within the burner firing tube 13; b. The heat radiated from the surface of the burner firing tube 13 to the internal surface of the ventilated tube 7 which is subsequently absorbed by the circulating air flow; c. The circulating airflow absorbs the conducted heat from the surface of the ventilated tube 7 directly under the temperature balancing channel 11 which is transporting the heat of combustion directed through it from the refractory block 8; and d. The heat of combustion that is directed into the said cavity between the burner firing tube 13 and the ventilated tube 7 from the refractory block 8.

Continuing with FIG. 3*a*, the circulating airflow that enters the temperature balancing channel 11 absorbs the heat from the heat of combustion air that is directed into the cavity formed between the temperature balancing channel 11 and the exterior top and bottom surface of ventilating tube 7 from the refractory block 8 and out the opposite side of the temperature balancing channel.

The circulating airflow that passes between temperature balancing channel and the airflow restrictor baffles 10 absorbs the conducted heat of the temperature balancing channel 11 exterior surfaces as a result of the heat of combustion air directed from the refractory block 8 through the passageway of the temperature balancing channel 11.

The circulating air that passes between the air restrictor baffles 10, FIG. 3*a*, and the mounting rail 6 does not absorb any heat and is therefore considered bypass air which serves to blend the temperature gain across the heater assembly prior to the mixing action of the circulating air blower.

Figure 4:
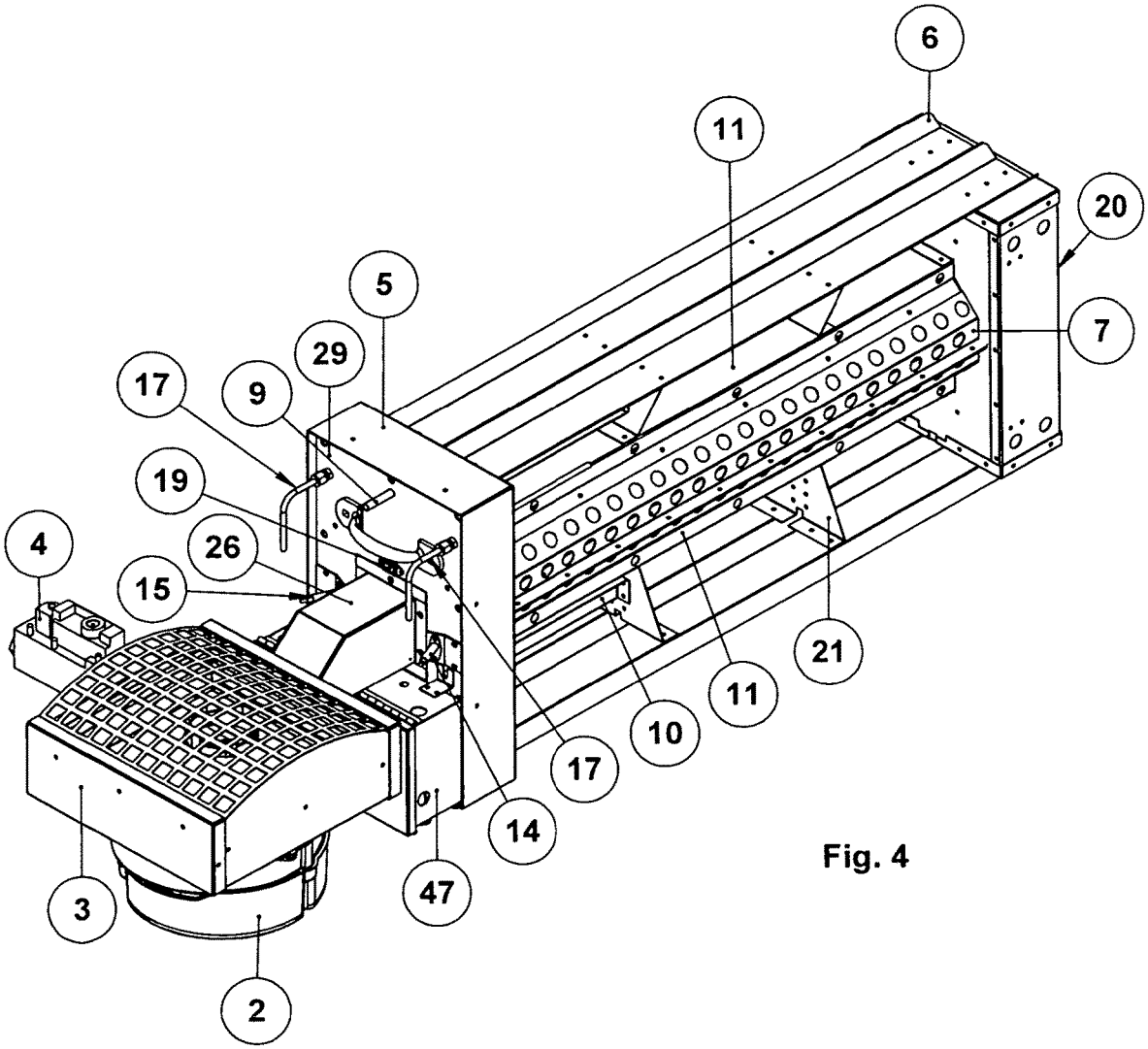
FIG. 4 is an isometric representation of the current invention.

The isometric view of the heater assembly 1 of FIG. 4 begins with the optional filter housing 3 that directly connects to the inlet venturi of the premix gas and combustion air blower 2 (partially hidden by the filter housing 3). The zero governor gas valve, 4 is connected to the gas port on the side of the inlet venturi (hidden, but mounted on the combustion air blower). The combustion air envelope 26 carries the fuel-air mixture from the premix gas and combustion air blower 2 to the premix burner 12 (not shown in this figure) which is mounted inside the insulated bulkhead 5. The spark igniter 14 and the flame rod 15 are mounted on the insulated bulkhead face plate 29 along with the sight glass 19. The static pressure ports 17 and the emissions sampling tube 9 all pass through the insulated bulkhead 5.

Beyond the insulated bulkhead 5, are the heater assembly 1 components that are positioned in the circulating airflow of the shrink wrap conveyor oven of FIG. 3. The four mounting rails 6 are provided to accommodate both right and left hand conveyor installations. These mounting rails are bolted to the back of the insulated bulkhead 5 on the near end and secured to the refractory block enclosure 20 on the far end.

The burner firing tube 13 is bolted to the insulated bulkhead 5 (not shown in this Figure) and extends to the refractory block 8 and centered inside the ventilated tube 7. The ventilated tube 7 is also bolted to the insulated bulkhead 5 on the near end and is embedded into the refractory block 8 on the far end of the heater assembly 1. The heat of combustion air produced by the premix burner 12 (not shown in this Figure) and flows inside the burner firing tube 13 (not shown as indicated above) where it is delivered to the refractory block 8 and where it is directed back by the refractory block 8 into the inside cavity between the burner firing tube 13 and the ventilated tube 7. The heat of combustion air within the said cavity is diluted by the circulating airflow that enters the ventilation holes in the ventilated tube 7 and exit that portion of the ventilated tube 7 on the opposite side.

The temperature balancing channel 11 is attached to ventilated tube 7 and is also embedded into the refractory block 8 as well as being secured to the refractory block enclosure 20. There is a temperature balancing channel 11 located above and below the ventilated tube 7. The heat of combustion air that is directed back by the refractory block 8 into the top and bottom cavity between the temperature balancing channel 11 and the ventilated tube 7 is pushed down the said cavity with dilution air being added along its length from the circulating air stream entering the upstream holes in the vertical sides of the temperature balancing channels 11. After the circulating air flow has mixed with the heat of combustion air it exits the holes provided on the downstream in the vertical sides of the temperature balancing channels 11 and the four ventilation holes in the center section are provided on both sides of the ventilation tube 7 and directly under the temperature balancing channel 11 (not shown in this figure).

As previously mentioned, the burner flame generates a higher temperature rise on the surface of the burner firing tube 13 on the near end of the heater assembly 1 than on the far end of the heater assembly 1 since the flame length at the maximum firing rate is only half the length of the burner firing tube 13. However, the heat of combustion air that exits the burner firing tube 13 carries a higher percentage of the total heat produced by the gas burner, therefore, the arrangement of the ventilation holes that are provided in the ventilation tube 7 and the temperature balancing channels 11 of current invention are spaced to permit the heat of combustion air to move further along the cavities provided to equalize the thermal gain along the length of the heater assembly 1.

There are three spaces provided for mounting air restrictor baffles 10 above and below the temperature balancing channels 11 to the rail mounting supports 21 and the insulated bulkhead 5 on the near end and the refractory block enclosure 20 on the far end. The objective of the air restrictor baffles 10, when installed, is to add resistance to the heater assembly 1 which forces more circulating air flow through the ventilated tube 7 and temperature balancing channel 11 as the height of air restrictor baffle 10 is increased as well as reducing the volume of bypass air within that section. The more air that flows through the ventilation holes for that section on the upstream side of the heater assembly 1, the lower the temperature rise leaving the ventilation holes on the downstream side of that section the heater assembly 1. Furthermore, more airflow is pushed through the other sections that are without air restrictor baffles 10.

Increasing the height of only the air restrictor baffles 10 for the center section between the rail mounting supports 21 may be a solution to balance the temperature across the length of a heater assembly 1 that was experiencing slightly warmer temperatures on the heater ends compared to the middle section.

The configuration provided in FIG. 4 only utilizes air restrictor baffles 10 in the section between the bulkhead 5 and the rail mounting supports 21 in order to force more circulating airflow into the ventilating tube 7 for the first section while the other two sections were designed to have more circulating airflow bypass the heating sections for more mixing downstream. This configuration was found to produce even temperatures in a specific conveyor oven system at an oven temperature of 425° F.

Figure 5:
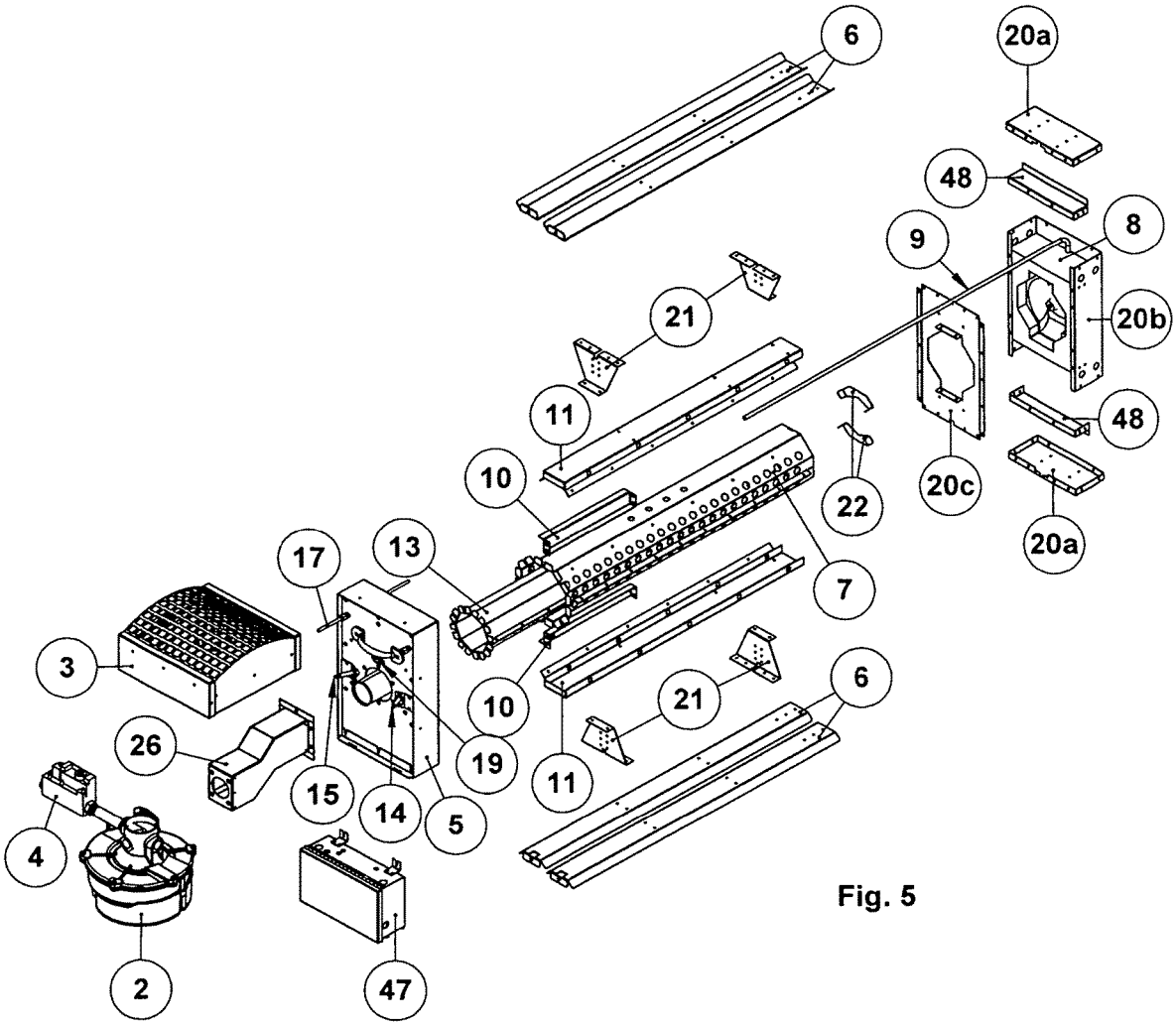
FIG. 5 provides an exploded and isometric view of the current invention.

Two ventilation holes have been provided in the top and bottom side panels of the refractory block enclosure 20 for the circulating airflow to absorb the conducted heat from the refractory block 8 and the external surfaces of the refractory block enclosure 20. It was found that the refractory block 8 retained a significant amount of heat during operation and the extremely hot refractory block resembled an afterburner in a burn-off oven. This characteristic consumed carbon emissions such that the downstream emissions actually measured zero carbon monoxide (CO) for all firing ranges, FIG. 5 presents an exploded view of the components that comprises the heater assembly 1. The exploded view improves the visibility of some of the components of the heater assembly 1 from that shown in the isometric view shown in FIG. 4. The premix gas and combustion air blower 2 presents the interface information regarding the inlet venturi for the mounting surface of the filter housing 3, the connection point for the zero governor gas valve 4 and associated piping components to the embossments on the side of the inlet venturi casting and the gas and combustion air blower 2 outlet's connection to the combustion air envelope 26.

The combustion air envelope 26 is a fully welded assembly that transports the fuel/air mixture to the premix burner 12. The metal mesh cylinder of the premix burner 12 is visible with the combustion air envelope 26 removed. The capped cylinder provides the barrier between the fuel/air mixture and the burner flame that takes place on the inside of the perforated metal cylinder.

The octagon shaped burner firing tube 13 with its flanged joint is attached to the insulated bulkhead 5 and is positioned in the center of the octagon shaped ventilated tube 7 by the tube block-offs 22. Besides securing and centering the burner firing tube 13 in the ventilated tube, the tube block-offs 22 serve to block the heat of combustion air from entering the top and bottom sections of the ventilated tube 7 leaving only the side cavities between the burner firing tube 13 and the ventilated tube 7 and the open ends of the temperature balancing channels 11.

The refractory block 8 and the refractory block enclosure 20*a, b* and *c* are shown along with the emission sampling tube 9. The emission sampling tube 9 is embedded into the extruded slot in the refractory block 8 prior to the assembly of the refractory block enclosure 20. The interior cutout of the refractory block 8 forms the curved surface that turns the heat of combustion air to direct it to the open cavities of the ventilated tube 7 and temperature balancing channel 11. In the center of the refractory block 8 is a raised shape that includes a hole that permits the emissions tube 9 to capture the combustion emissions generated by the premix burner 12 prior to any interaction of the emission, such as, carbon monoxide, to the hot surface of the refractory block 8.

Figure 6B:
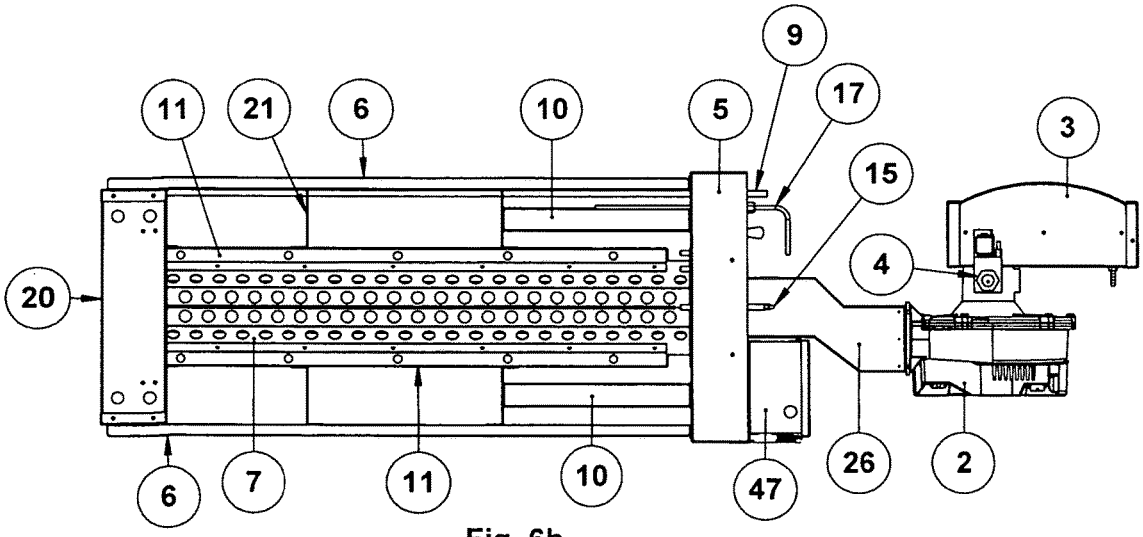
FIGS. 6*a* and 6*b* provide the right and left side views of the heater assembly of the current invention.
Figure 6A:
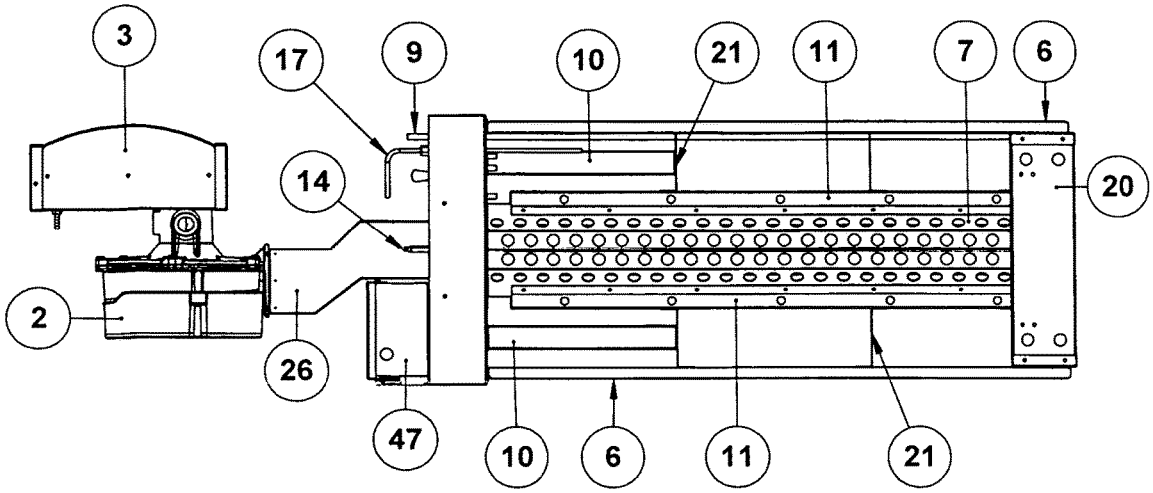

FIG. 6*a* and FIG. 6*b* present the left and right hand side views of the heater assembly 1 to demonstrate the ventilation holes provided in the ventilated tube 7, the temperature balancing channel 11 and the refractory block enclosure 20 are identical on both sides of the heater assembly 1.

FIG. 7 provides sectional views of the heater assembly 1. FIG. 7*a* presents an enlarged view, FIG. 7*d*, of the end of the 4 inch burner firing tube 13 with arrows representing the heat of combustion air flow direction around the curved surface machined into the refractory block 8 and into the open cavity between the burner firing tube 13 and the ventilated tube 7. FIG. 7*b* presents an enlarged view, FIG. 7*c*, of the end of the 4 inch burner firing tube 13 with arrows representing the heat of combustion air flow direction around the curved surface machined into the refractory block 8 and into the open cavity between the ventilated tube 7 and the temperature balancing tube 11.

Figure 7B:
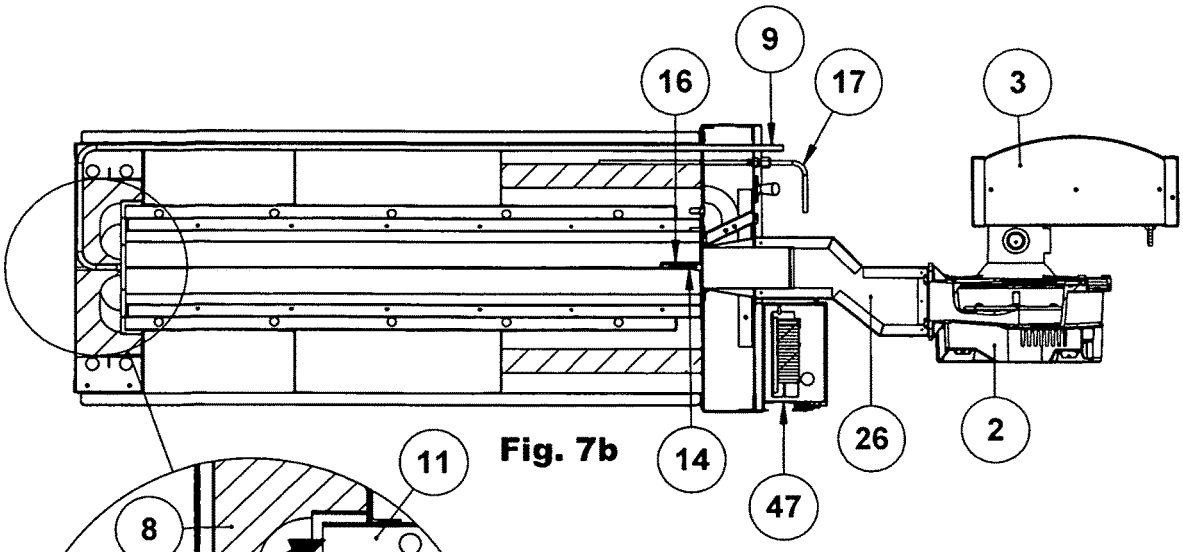
FIGS. 7*a*, 7*b*, 7*c* and 7*d* provide section views of the octagon version of the heater assembly near the the center of the horizontal and vertical cut through the heater assembly of the current invention.
Figure 7C:
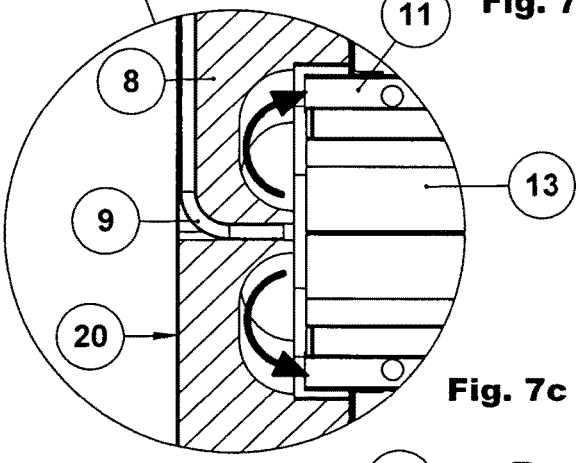

Also shown in FIG. 7*b* is the positioning of the emissions tube 9 in the refractory block 8.

Figure 8:
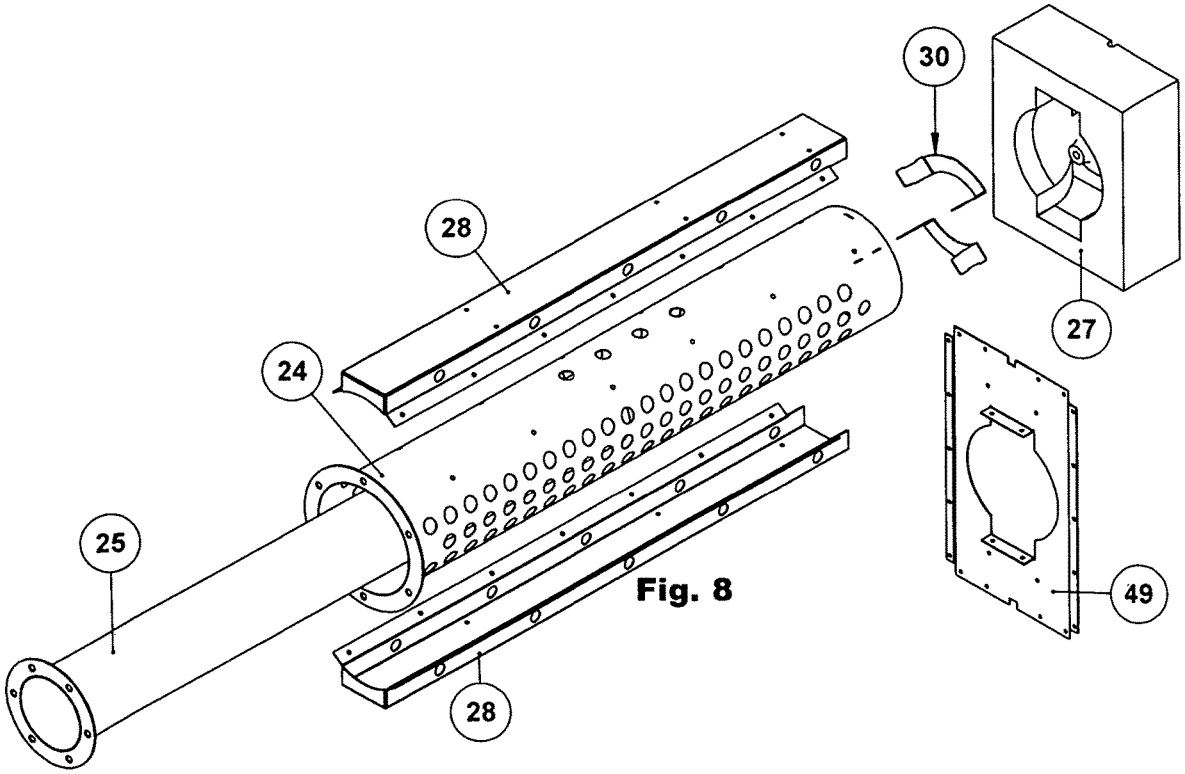
FIG. 8 provides an exploded and isometric view of the round version of the burner firing tube, ventilated tube, tube block-offs, temperature balancing channel and refractory block.

FIG. 8 provides the components of the heater assembly 1 that would be impacted if the round version of the burner firing tube 25 and the round version of the ventilated tube 24 were utilized. There would be a round version of the temperature balancing channel 28 as well as round versions of the tube block-offs 30. The refractory block 27 and the front of the refractory block enclosure 20*c* would need to be machined to match the round ventilated tube 24.

Figure 9:
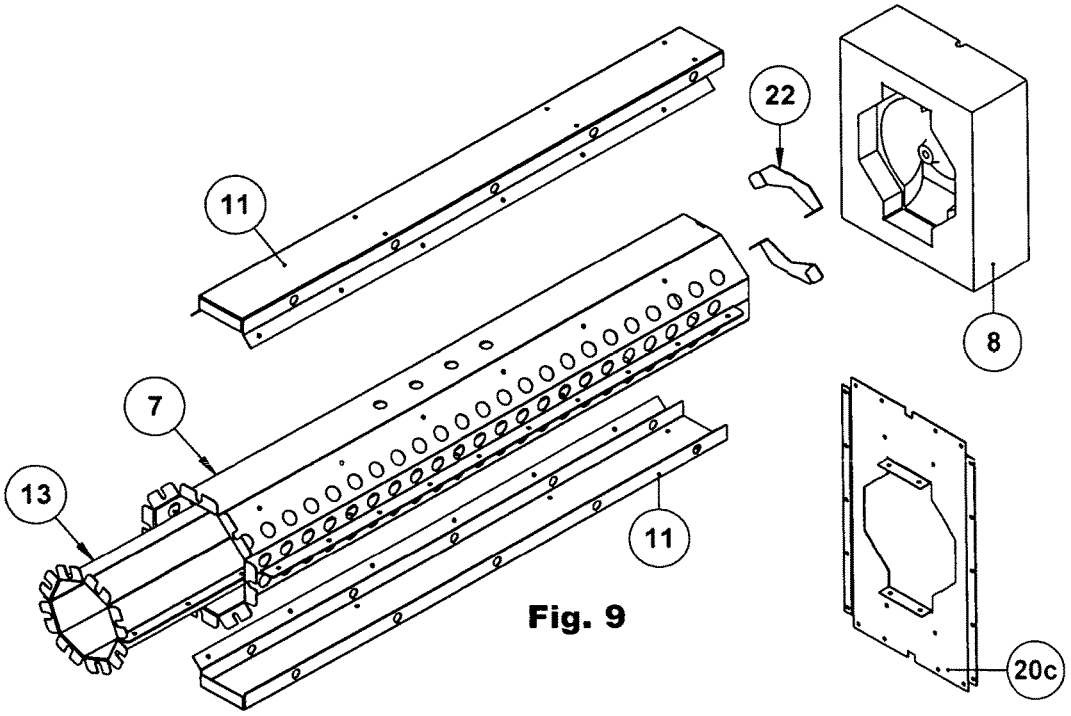
FIG. 9 presents an exploded view of the octagonal version of the heater assembly of the current invention.

FIG. 9 provides a side by side comparison of the octagon design affected components.

Figure 10B:
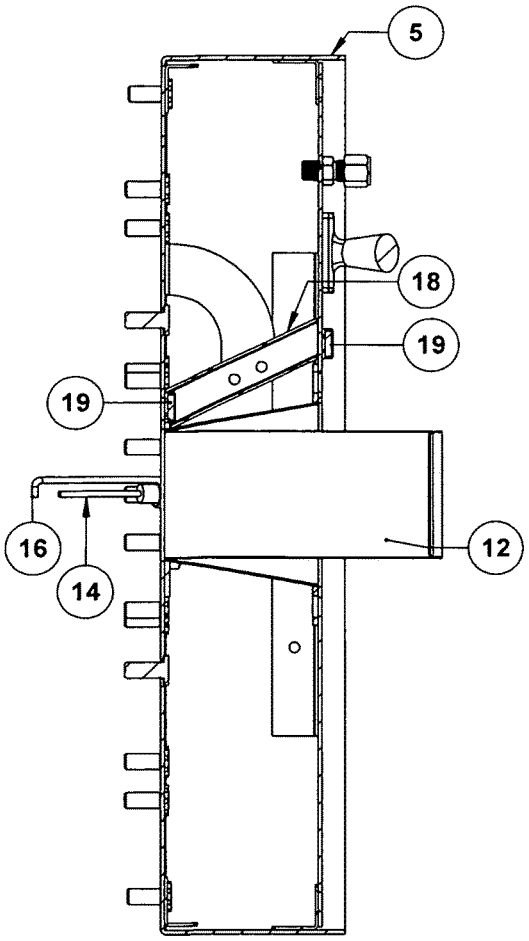
FIGS. 10*a*, 10*b*, and 10*c* provide views of the insulated bulkhead along with the section views along the vertical and horizontal cuts shown as Section A-A or Section B-B, and also showing the ground rods in FIGS. 10 *a* and 10*b;*
Figure 10A:
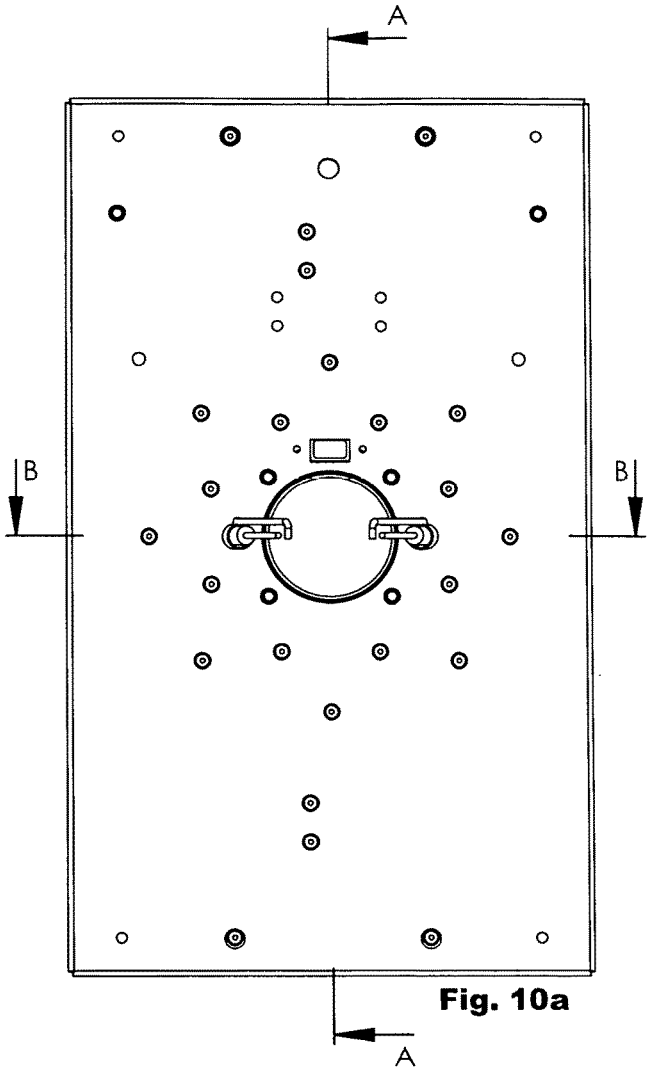
Figure 10C:
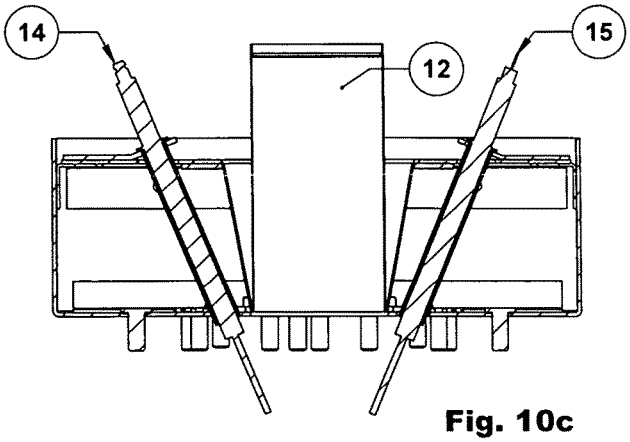

FIG. 10*a* addresses the insulated bulkhead 5 and provides section views in FIG. 10*b* and FIG. 10*c* in order to add design details. FIG. 10*a* shows the positioning of the spark igniter 14, ground rod 16 and flame rod 15 in relationship to the premix burner 12 outlet. FIG. 10*b* shows a section view of the premix burner 12 and the sight glass 19 with its associated sight glass viewing channel 18. FIG. 10*c* adds clarity of the flame rod 15 and spark igniter 14 positioning with respect to the premix burner 12 outlet.

Figure 7A:
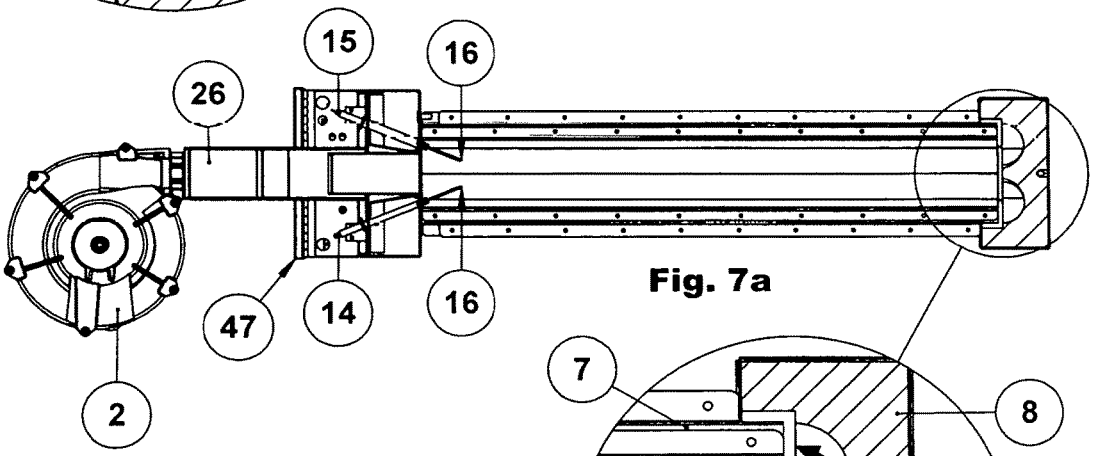
Figure 7D:
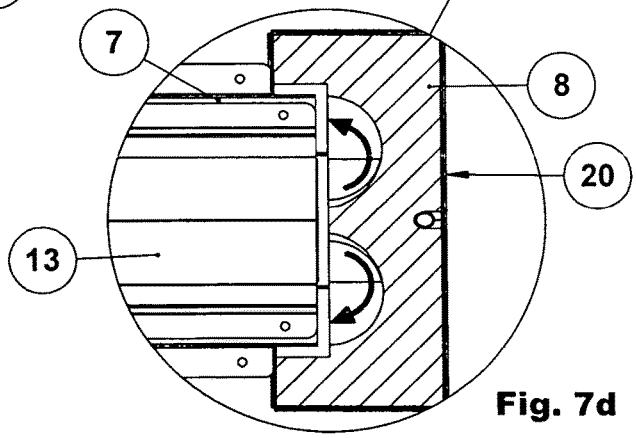
Figure 11A:
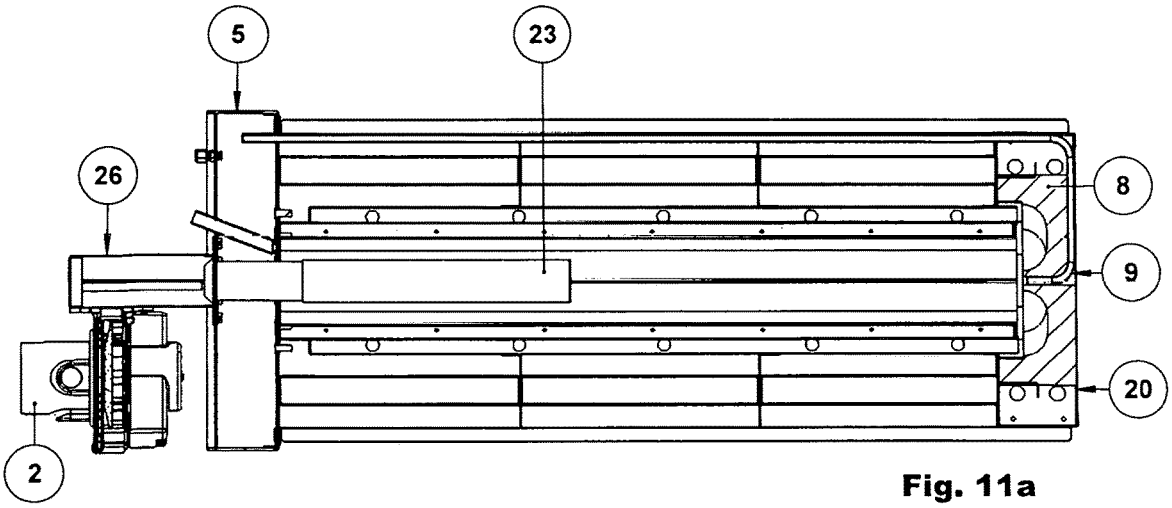
FIGS. 11*a*, 11*b*, and 11*c* present the section views similar to FIG. 7 near the center of the horizontal and vertical cut through the heater assembly of the current invention that utilizes an alternative design premix tube burner.
Figure 11C:
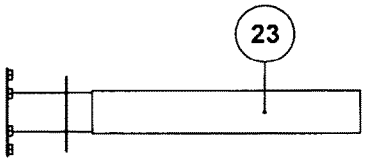
Figure 11B:
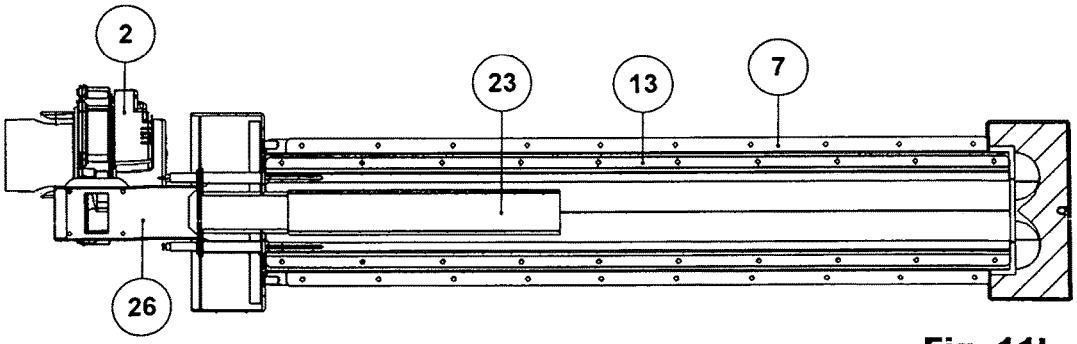

FIG. 11*a* and FIG. 11*b* provide sectional views of the heater assembly 1 that is similar to those provided in FIG. 7*a* and FIG. 7*b* except the preferred premix burner 12 is replaced with an alternate burner design that is known as the premix tube burner 23.

Figure 12A:
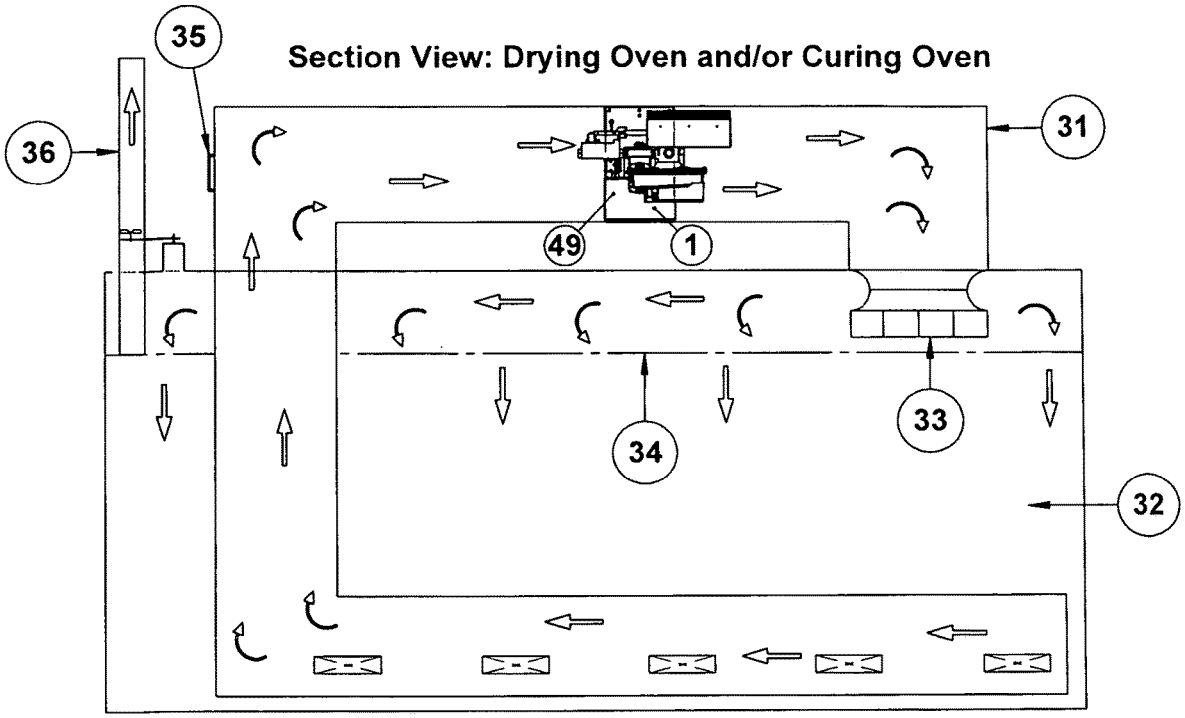
FIGS. 12 and 12*a* is an isometric and section view of a generic drying oven and/or curing oven that utilizes a direct gas-fired duct heater.
Figure 12:
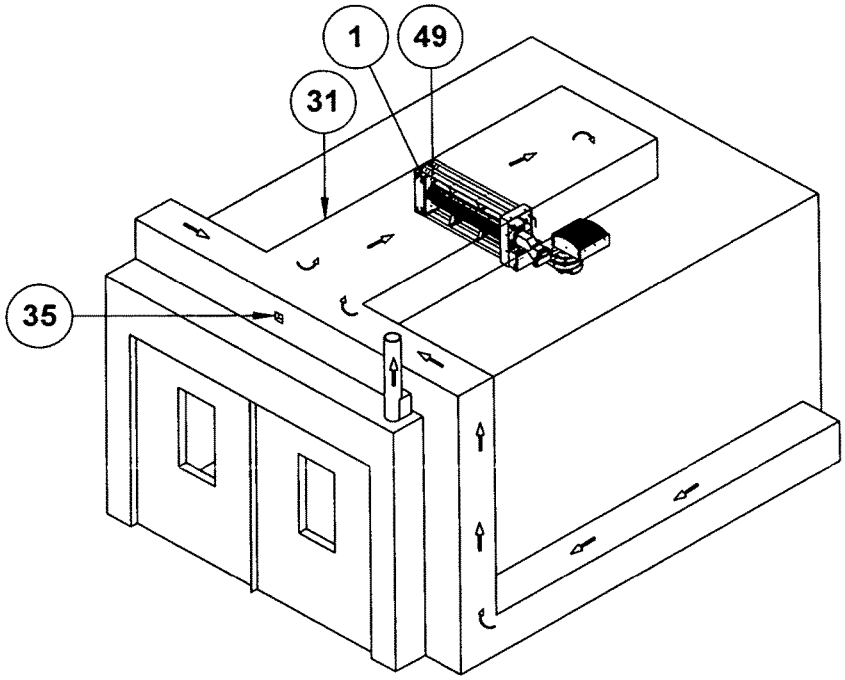

FIG. 12 presents an isometric and section view of a generic drying oven and/or curing oven that shows the direct fired-gas process air duct heater assembly 49 that contain heater assembly 1 located in the ductwork 31 that moves air from the heated chamber 32 shown in FIG. 12*a* to the direct fired-gas process air duct heater assembly 49 and on to the circulating fan 33 that discharge the circulating airstream into a porous ceiling plenum 34. A fresh air intake 35 provides dilution air to the circulating air stream upstream of the heater assembly and an exhaust stack 36 removes the contaminated air from the heated chamber 32.

Figure 13A:
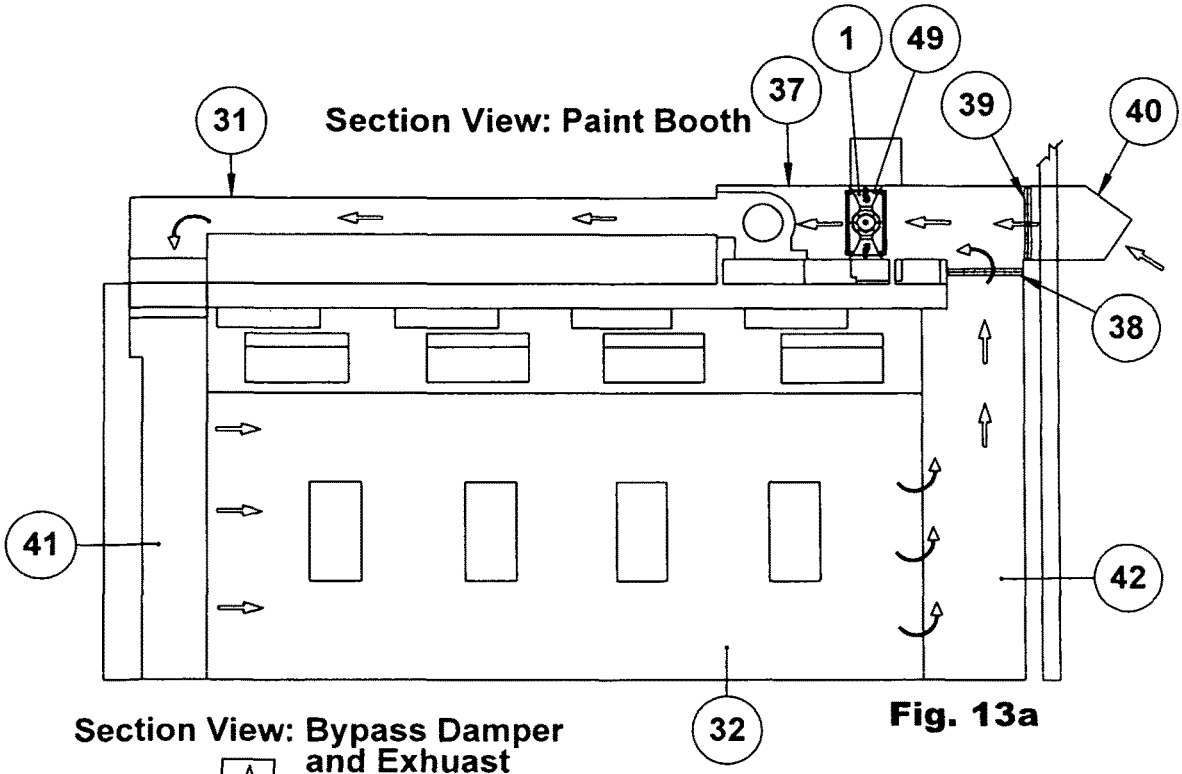
FIGS. 13 and 13*a* is an isometric and section view of a generic paint booth that is shown as being equipped with a direct gas-fired packaged process air heater or direct gas-fired process air duct heater that utilizes the heater assembly of the current invention.
Figure 13B:
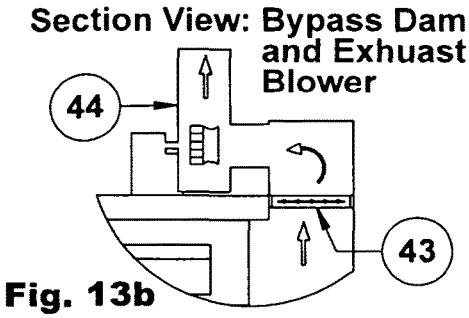
FIG. 13*b* provides a partial view of the bypass damper and the exhaust blower receiving air from the exhaust pletta of the heated chamber of the invention.
Figure 13:
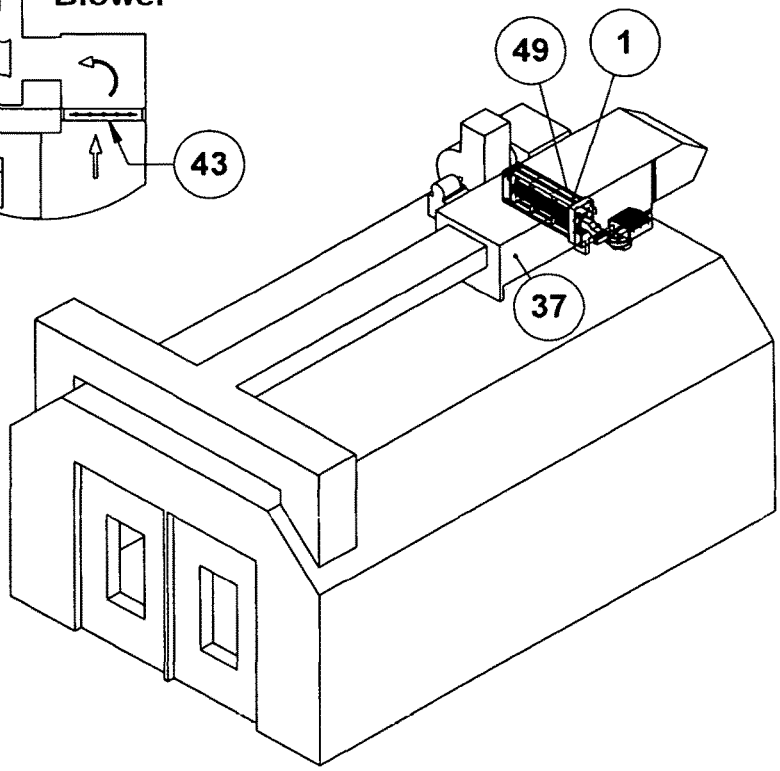

FIG. 13 presents an isometric and section view of a generic paint booth that is equipped with a direct gas-fired packaged process air heater assembly 37 or direct gas-fired process air duct heater assembly 49 that contain the heater assembly 1. In the ventilation mode while painting is occurring, the recirculating damper 38 shown in FIG. 13*a* is closed and the outside air damper 39 is open allowing fresh air to enter the intake hood 40 and through the direct gas-fired packaged process air heater assembly 37 or direct gas-fired process air duct heater assembly 49. The air discharged from the direct gas-fired packaged process air heater 37 or direct gas-fired process air duct heater assembly 49 circulating fan-is passed through the ductwork 31 to the filtered discharged plenum 41 which is located inside the entrance of the heated chamber 32. As the air moves through the heated chamber 32, it enters the exhaust plenum 42 and through the bypass damper 43 as shown in the section view titled Bypass Damper and Exhaust Blower on FIG. 13*b* and out the exhaust fan 44. In the paint drying mode, the direct gas-fired packaged process air heater 37 or direct gas-fired process air duct heater assembly 49 circulating fan-operates in the recirculation mode with the outside air damper 39 and the bypass damper 43 partially open and the recirculating damper 38 fully open. The direct gas-fired process air heater 37 or direct gas-fired process air duct heater assembly 49-circulating fan-draws most of its air from the exhaust plenum 42 and a smaller portion (5 to 20%) from the intake hood 40. This circulated airflow passes through the direct gas-fired packaged process air heater assembly 37 or direct gas-fired process air duct heater assembly 49—where heat is added to this airstream until it reaches the desired oven temperature of the heated chamber 32. Any excess air in the system will vent through the partially open bypass damper 43 to the outdoors.

Figure 14A:
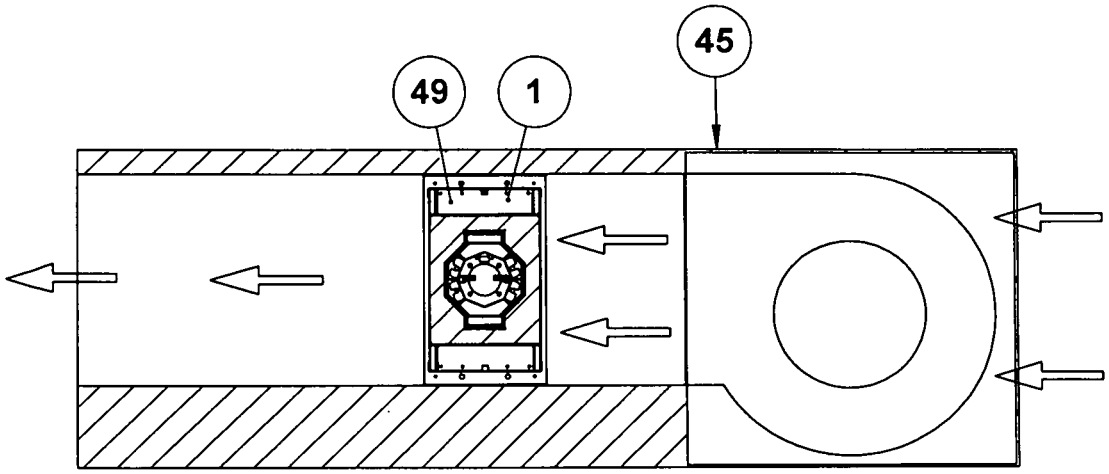
FIGS. 14 and 14*a* is an isometric and section view of a blow-through heater design that included the heater assembly of the current invention mounted downstream of the blower.
Figure 14:
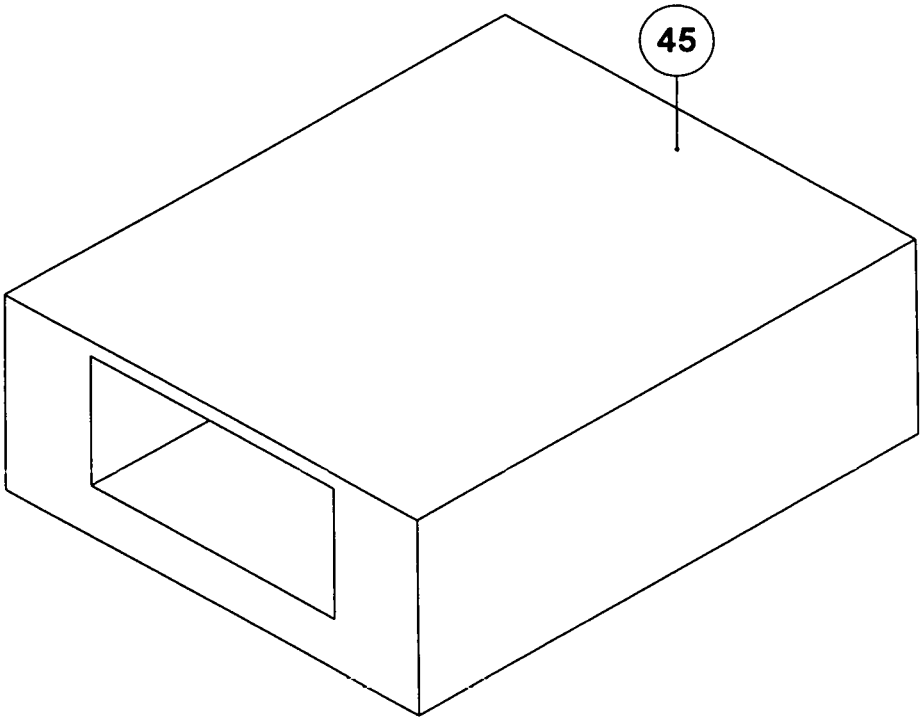

FIG. 14 is an isometric and section view of a blow-through heater design 45 that incorporates the heater assembly 1 shown in FIG. 14*a* mounted downstream of the blower.

Figure 15A:
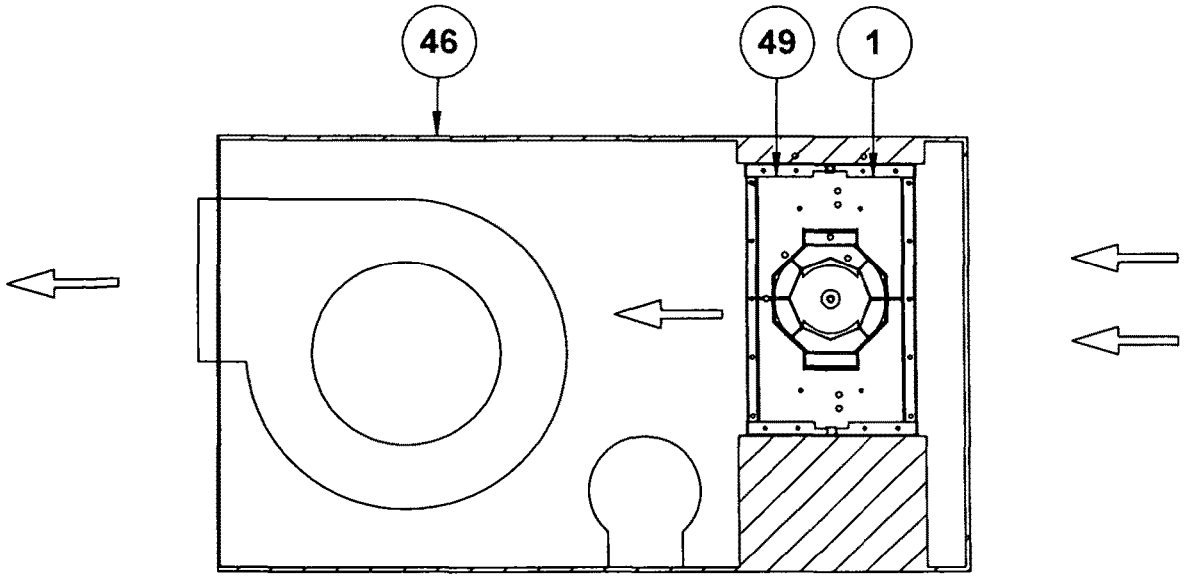
FIGS. 15 and 15*a* is an isometric and section view of a draw-through heater design that included the heater assembly of the current invention mounted upstream of the blower.
Figure 15:
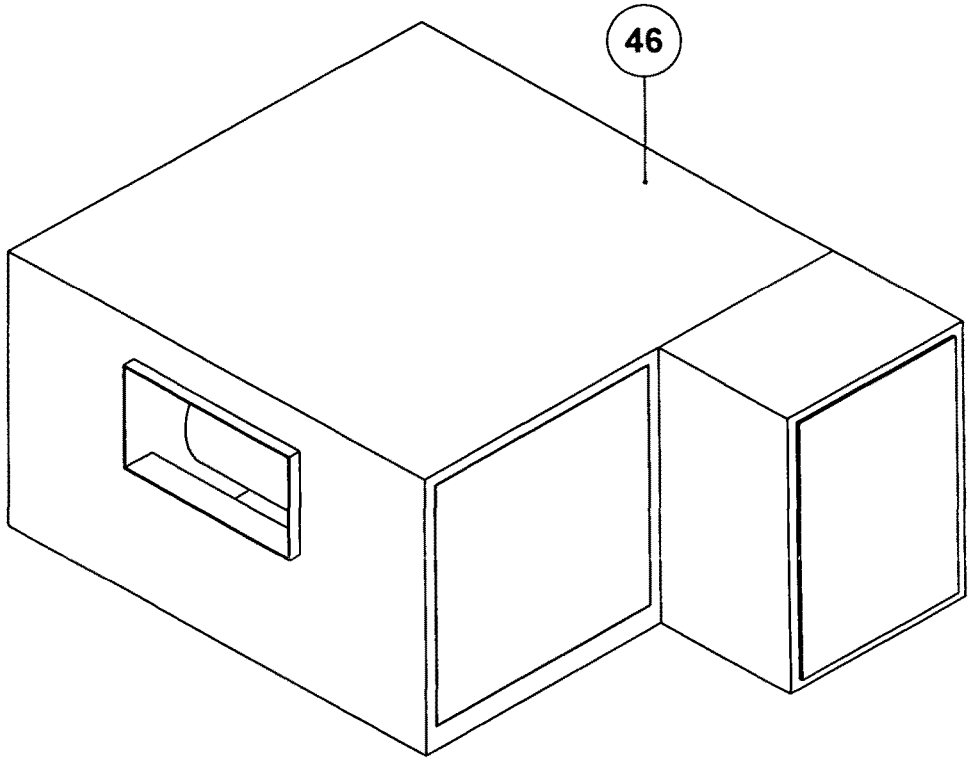

FIG. 15 is an isometric and section view of a draw-through heater design 46 that incorporates the heater assembly 1 mounted shown in FIG. 15*a* upstream of the blower.

Variations or modifications to the subject matter of this invention may occur to those skilled in the art upon review of the development as described herein. Such variations, if within the spirit of this invention, are intended to be encompassed within the scope any claims to patent protection issuing hereon. The summary of the invention herein, its depiction in the drawings, and description in the preferred embodiment, are intended for illustrative purposes only.

APPENDIX

| Item Number | Patent Nomenclature |
|---|---|
| 1 | Heater Assembly |
| 2 | Premix Gas and Combustion Air Blower |
| 3 | Filter Housing |
| 4 | Zero Governor Gas Valve |
| 5 | Insulated Bulkhead Enclosure |
| 6 | Mounting Rail |
| 7 | Ventilated Tube-(octagon design) |
| 8 | Refractory Block |
| 9 | Emissions Sampling Tube |
| 10 | Airflow Restrictor Baffles |
| 11 | Temperature Balancing Channel-(octagon design) |
| 12 | Premix Burner |
| 13 | Burner Firing Tube-(octagon design) |

APPENDIX-continued

| Item Number | Patent Nomenclature |
|---|---|
| 14 | Spark Igniter |
| 15 | Flame Rod |
| 16 | Ground Rod |
| 17 | Static Pressure Ports |
| 18 | Sight Glass Viewing Channel |
| 19 | Sight Glass |
| 20 | Refractory Block Enclosure |
| 21 | Rail Mounting Support |
| 22 | Tube Block-Off-(octagon design) |
| 23 | Tube Burner-Premix |
| 24 | Ventilated Tube-(round design) |
| 25 | Burner Fire Tube-(round design)c |
| 26 | Combustion Air Envelope |
| 27 | Refractory Block-(round design) |
| 28 | Temperature Balancing Channel-(round design) |
| 29 | Bulkhead Face Plate-(insulated) |
| 30 | Tube Block-Off-(round design) |
| 31 | Ductwork |
| 32 | Heated Chamber |
| 33 | Circulating Fan |
| 34 | Porous Ceiling Plenum |
| 35 | Fresh Air Intake |
| 36 | Exhaust Stack |
| 37 | Direct Gas-Fired Process Air Duct Heater |
| 38 | Recirculating Damper |
| 39 | Outside Air Damper |
| 40 | Intake Hood |
| 41 | Filtered Discharge Plenum |
| 42 | Exhaust Plenum |
| 43 | Bypass Damper |
| 44 | Exhaust Fan |
| 45 | Blow-Through Heater Design |
| 46 | Draw-Through Heater Design |
| 47 | Control Panel |
| 48 | Refractory Block Retainer |
| 49 | Direct Gas-Fired Process Air Duct Heater |

What is claimed is:

1. A direct gas-fired air heater assembly utilizing a premix burner for use for application to a shrink wrap conveyor oven to provide uniform dissemination of heated air in a recirculating air stream during its application, for shrink wrapping of polymer film, comprising:

a heater assembly, having a premix gas and combustion air blower with a burner assembly at its entrance end, and a refractory block provided at its opposite end, an insulated bulkhead provided at the entrance end of the heater assembly and provided for mounting of the said premix burner, blower, and other heater accessories at the entrance end of the heater assembly, a ventilating tube extending between the insulated bulkhead at one end, and securing with the refractory block at its other end, a burner firing tube extending into the ventilating tube, said burner firing tube provided for conveying the gas-fired processed air from the entrance end to the opposite end of said burner firing tube, whereat the refractory block directs the direction of flow of said heated air to the space between said burner firing tube and the ventilating tube, said ventilating tube having a series of perforations provided therethrough, and discharging heated air through the ventilating tube and into the region of the shrink wrap conveyor oven to provide for the uniform dissemination of the heated air into a recirculating air stream to provide for shrink wrapping of the polymer film surrounding any packaged goods being conveyed through the conveyor oven assembly; and wherein the refractory block enclosure has holes provided above and below the refractory block to disseminate a portion of the heat absorbed by the refractory block to the circulating airflow.

2. The direct gas-fired air heater assembly of claim 1, wherein at least one of said burner firing tube and ventilating tube is of round configuration.

3. The direct gas-fired air heater assembly of claim 1, wherein at least one of said burner firing tube and ventilating tube is of polygonal shape along its length.

4. The direct gas-fired air heater assembly of claim 3 wherein said at least one burner firing tube and ventilating tube is of octagonal shape.

5. The direct gas-fired air heater assembly of claim 1, wherein said air heater assembly is applied within a shrink wrap chamber for shrinking polymer film around packaged goods during their processing.

6. The direct gas-fired air heater assembly of claim 1 wherein at least one temperature balancing channel provided upon the exterior surface of the ventilating tube along its length to further control the dissemination of the heated air into the shrink wrap chamber during processing of the packaged goods conveyed through the shrink wrap oven.

7. The direct gas-fired air heater assembly of claim 1 wherein said heater assembly is perpendicularly arranged through the shrink wrap conveyor in its assembly.

8. The direct gas-fired air heater assembly of claim 1, wherein said burner produces no visible external flame during its operation and the air stream that flows into and around the heater assembly to provide uniform dissemination of heated air, thereby minimizing clearances requirements between the heater assembly and downstream components.

9. The direct gas fired heater assembly of claim 6 wherein said ventilation tube has holes provided under the temperature balancing channel for delivering a portion of the combustion heat to a localized section of the heater assembly.

10. The direct gas-fired air heater assembly of claim 6, wherein air restrictor baffles are provided between the insulated bulkhead and rail mounting supports, between rail mounting supports, and/or between the rail mounting supports and the refractory block enclosure to reduce the temperature leaving the ventilated tube for the section of the heater with the air restrictor baffles or to increase the airflow volume in heater sections without the air restrictor baffles as a means to uniformly disseminate the thermal rise across the length of the heater assembly.

11. A direct gas-fired air heater assembly utilizing a premix burner for use for application to a shrink wrap conveyor oven to provide uniform dissemination of heated air in a recirculating air stream during its application, for shrink wrapping of polymer film, comprising:

a heater assembly, having a premix gas and combustion air blower with a burner assembly at its entrance end, and a refractory block provided at its opposite end, an insulated bulkhead provided at the entrance end of the heater assembly and provided for mounting of the said premix burner, blower, and other heater accessories at the entrance end of the heater assembly, a ventilating tube extending between the insulated bulkhead at one end, and securing with the refractory block at its other end, a burner firing tube extending into the ventilating tube, said burner firing tube provided for conveying the gas-fired processed air from the entrance end to the opposite end of said burner firing tube, said refractory block directs a portion of said heated air to the space between said burner firing tube and the ventilating tube, said ventilating tube having block-off sections attached to the interior surface top and bottom ends of the ventilated tube and extending to the burner firing tube external surface so as to ensure the refractory block directs the remaining portion of the heated air into the cavity of said temperature balancing channels mounted to the top and bottom exterior surface of said ventilated tube, said ventilating tube and temperature balancing channels having a series of perforations provided therethrough, and discharging heated air through the ventilating tube and temperative balancing channels and into the region of the shrink wrap conveyor oven to provide for the uniform dissemination of the heated air into a recirculating air stream to provide for shrink wrapping of the polymer film surrounding any packaged goods being conveyed through the conveyor oven assembly; and wherein the refractory block enclosure has holes provided above and below the refractory block to disseminate a portion of the heat absorbed by the refractory block to the circulating airflow.

12. The direct gas-fired air heater assembly of claim 11, wherein air restrictor baffles are provided between the insulated bulkhead and rail mounting supports, between rail mounting supports, and/or between the rail mounting supports and the refractory block enclosure to reduce the temperature leaving the ventilated tube for the section of the heater with the air restrictor baffles or to increase the airflow volume in heater sections without the air restrictor baffles as a means to uniformly disseminate the thermal rise across the length of the heater assembly.

13. The direct gas-fired air heater assembly of claim 11, wherein said burner produces no visible external flame during its operation and the air stream that flows into and around the heater assembly to provide uniform dissemination of heated air, thereby minimizing clearances requirements between the heater assembly and downstream components.

14. A direct-gas fired air process air duct heater assembly utilizing a premixed burner for use for application in drying ovens, curing ovens, and the like, and which heater assembly provides for a uniformed dissemination of heated air as a recirculating air stream during its application, comprising;

a heater assembly, having a premix gas and combustion air blower with a burner assembly at its entrance end, and a refractory block provided at its opposite end, an insulated bulkhead provided at the entrance end of the heater assembly and provided for mounting of the said premix burner, blower, and other heater accessories at the entrance end of the heater assembly, a ventilating tube extending between the insulated bulkhead at one end, and securing with the refractory block at its other end, a burner firing tube extending into the ventilating tube, said burner firing tube provided for conveying the gas-fired processed air from the entrance end to the opposite end of said burner firing tube, whereat the refractory block directs the direction of flow of said heated air to the space between said burner firing tube and the ventilating tube, said ventilating tube having a series of perforations provided there through, and discharging heated air through the ventilating tube and into the region of the said assembly to provide for the uniform dissemination of the heated air into a recirculating air stream to provide for its usage in drying and curing of the materials contained within the oven assembly.

15. The direct gas-fired air heater assembly of claim 14 wherein at least one temperature balancing channel provided upon the exterior surface of the ventilating tube along its length to further control the dissemination of the heated air into the circulating airflow of the application in drying ovens, curing ovens, and the like.

16. The direct gas fired heater assembly of claim 14 wherein said ventilation tube has holes provided under the temperature balancing channel for delivering a portion of the combustion heat to a localized section of the heater assembly.

17. The direct gas-fired air heater assembly of claim 14, wherein air restrictor baffles are provided between the insulated bulkhead and rail mounting supports, between rail mounting supports, and/or between the rail mounting supports and the refractory block enclosure to reduce the temperature leaving the ventilated tube for the section of the heater with the air restrictor baffles or to increase the airflow volume in heater sections without the air restrictor baffles as a means to uniformly disseminate the thermal rise across the length of the heater assembly.

18. The direct gas-fired air heater assembly of claim 14, wherein said burner produces no visible external flame during its operation and the air stream that flows into and around the heater assembly to provide uniform dissemination of heated air, thereby minimizing clearances requirements between the heater assembly and downstream components.

19. A direct gas-fired process air duct heater assembly utilizing a premixed burner for use for applications in drying ovens, curing ovens, and the like, and which heater provides for a uniformed dissemination of heated air as a recirculating air stream during its application, comprising;

a heater assembly, having a premix gas and combustion air blower with a burner assembly at its entrance end, and a refractory block provided at its opposite end, an insulated bulkhead provided at the entrance end of the heater assembly and provided for mounting of said premix burner, blower, and other heater accessories at the entrance end of the heater assembly, a ventilated tube extending between the insulated bulkhead at one end, and securing with the refractory block at its other end, said burner firing tube extending into the ventilating tube, a burner firing tube provided for conveying the gas-fired processed air from the entrance end to the opposite end of said burner firing tube, whereat the refractory block directs a portion of said heated air to the space between said burner firing tube and the ventilating tube, said ventilating tube having block-off sections attached to the interior surface top and bottom ends of the ventilated tube and extending to the burner firing tube external surface so as to ensure the refractory block directs the remaining portion of the heated air into the cavity of said temperature balancing channels mounted to the top and bottom exterior surface of said ventilated tube, said ventilating tube and temperature balancing channels having a series of perforations provided therethrough, and discharging heated air through the ventilating tube and the temperature balancing channels and into the region of the said assembly to provide for the uniform dissemination of the heated air into a recirculating air stream to provide for its usage in drying and curing of the material contained within the oven assembly; and wherein the refractory block enclosure has holes provided above and below the refractory block to disseminate a portion of the heat absorbed by the refractory block to the circulating airflow.

20. The direct gas-fired air heater assembly of claim 19, wherein air restrictor baffles are provided between the insulated bulkhead and rail mounting supports, between rail mounting supports, and/or between the rail mounting supports and the refractory block enclosure to reduce the temperature leaving the ventilated tube for the section of the heater with the air restrictor baffles or to increase the airflow volume in heater sections without the air restrictor baffles as a means to uniformly disseminate the thermal rise across the length of the heater assembly.

21. The direct gas-fired air heater assembly of claim 19, wherein said burner produces no visible external flame during its operation and the air stream that flows into and around the heater assembly to provide uniform dissemination of heated air, thereby minimizing clearances requirements between the heater assembly and downstream components.

* * * * *